US010021484B2

(12) United States Patent
Sprogis et al.

(10) Patent No.: US 10,021,484 B2
(45) Date of Patent: Jul. 10, 2018

(54) METHOD OF AND APPARATUS FOR DETERMINING AN EQUALIZATION FILTER

(71) Applicant: SONARWORKS SIA, Rīga (LV)

(72) Inventors: Kaspars Sprogis, Salaspils (LV); Helmuts Bēms, Rīga (LV); Mārtiņš Popelis, Rīga (LV)

(73) Assignee: Sonarworks SIA, Riga (LV)

( * ) Notice: Subject to any disclaimer, the term of this patent is extended or adjusted under 35 U.S.C. 154(b) by 0 days.

(21) Appl. No.: 15/122,163

(22) PCT Filed: Feb. 25, 2015

(86) PCT No.: PCT/EP2015/053957

§ 371 (c)(1),
(2) Date: Aug. 27, 2016

(87) PCT Pub. No.: WO2015/128390

PCT Pub. Date: Sep. 3, 2015

(65) Prior Publication Data

US 2016/0366518 A1 Dec. 15, 2016

(30) Foreign Application Priority Data

Feb. 27, 2014 (GB) ..... 1403512.5
Feb. 28, 2014 (GB) ..... 1403513.3

(51) Int. Cl.

| | |
|---|---|
| ***H04R 3/04*** | (2006.01) |
| ***H04R 29/00*** | (2006.01) |
| ***H04S 7/00*** | (2006.01) |
| *H04R 1/10* | (2006.01) |

(52) U.S. Cl.
CPC ..... *H04R 3/04* (2013.01); *H04R 29/001* (2013.01); *H04S 7/306* (2013.01); *H04R 1/1008* (2013.01)

(58) Field of Classification Search
None
See application file for complete search history.

(56) References Cited

U.S. PATENT DOCUMENTS

| | | | | |
|---|---|---|---|---|
| 9,577,596 | B2 * | 2/2017 | Ray | H03G 5/165 |
| 2006/0093159 | A1 | 5/2006 | Koh et al. | |
| 2010/0166197 | A1 | 7/2010 | Fukuda et al. | |

(Continued)

FOREIGN PATENT DOCUMENTS

| | | | |
|---|---|---|---|
| LV | 14747 | A | 10/2013 |
| WO | 2010/014663 | A | 2/2010 |
| WO | 2013/124490 | A | 8/2013 |

OTHER PUBLICATIONS

Brochure: "G.R.A.S. 43AA-S2 Artificial Ear, Prepol"; Feb. 28, 2014; G.R.A.S. Sound & Vibration, Holte, Denmark.

(Continued)

*Primary Examiner* — Paul Huber
(74) *Attorney, Agent, or Firm* — David P. Dickerson

(57) ABSTRACT

A method for determining equalization filter parameters for a headphone, the method includes determining a composite response curve based on an average of amplitude response values measured from a plurality of measurement locations, the plurality of measurement locations, in cumulative, substantially spanning at least the headphone transducer, and determining the equalization filter parameters based on the determined composite response curve.

23 Claims, 24 Drawing Sheets

(56) References Cited

U.S. PATENT DOCUMENTS

| | | | | |
|---|---|---|---|---|
| 2011/0002471 | A1* | 1/2011 | Wihardja | H03G 5/005 381/56 |
| 2012/0219161 | A1 | 8/2012 | Amada et al. | |
| 2013/0003981 | A1* | 1/2013 | Lane | H04S 7/301 381/58 |
| 2013/0216052 | A1 | 8/2013 | Bruss et al. | |
| 2014/0010381 | A1 | 1/2014 | Doy | |
| 2014/0369519 | A1* | 12/2014 | Leschka | H03G 5/165 381/74 |
| 2015/0003649 | A1 | 1/2015 | Hobach | |
| 2015/0078596 | A1 | 3/2015 | Sprogis | |

OTHER PUBLICATIONS

Brochure: "Hearing-Protector Test Fixture Type 45CA"; Vers. Jun. 29, 2012; G.R.A.S. Sound & Vibration, Holte, Denmark.

Tyll Hertsens: "Headphone Measurement Procedures—Frequency Response"; Apr. 16, 2011; XP002739155; Retrieved from the Internet: URL:http://www.innerfidelity.com/content/headphone-measurement-proceedures-frequency-response [retrieved on Apr. 20, 2015].

* cited by examiner

METHOD OF AND APPARATUS FOR DETERMINING AN EQUALIZATION FILTER

BACKGROUND OF THE DISCLOSURE

Field of the Disclosure

The present inventions relate to a method and apparatus for measuring and applying acoustic parameters of a headphone. The inventions also relate to techniques for matching spectral balance between a headphone and a studio mixing monitor, a studio acoustic space, another headphone of a different make or model, guitar amplifier, or other electro-acoustic devices.

Description of the Related Art

The acoustic audio quality perceived by the listener of music often may not be the acoustic audio quality that the artist intended the listener to experience. A significant part of these significant differences occur during the conversion between the electronic audio signal and the acoustic audio signal (sound) by the sending electro-acoustic transducer (e.g., speakers) and related structures.

Indeed, mastering curves (e.g., a final EQ curve) are often chosen to accommodate for an average case scenario: a mix that will reproduce most recorded frequencies over small, cheap, and highly-nonlinear speakers. In any case, unless a recording artist in the recording studio is using exactly the same transducers in the same acoustic environment as a home or car listener, the spectral balance will rarely match.

US Patent Publication No. 20120219161 discloses an earphone-microphone interface in the shape of a tube. Preferably, the volume of the tube is approximately equal to the volume of the external auditory canal of a human being. The tube acoustically couples an earphone and a microphone for obtaining the earphone's amplitude response with respect to frequency. Parameters are generated to configure a correction filter based on a composite curve of a target frequency curve, such as a genre EQ curve, and the measured amplitude response.

SUMMARY OF THE PRESENT DISCLOSURE

Some embodiments provide methods for determining equalization filter parameters for a headphone. The methods include determining a composite response curve based on an average of amplitude response values measured from a plurality of measurement locations, the plurality of measurement locations, in cumulative, substantially spanning at least the headphone transducer, and determining the equalization filter parameters based on the determined composite response curve.

The methods may further include determining the composite response curve based on an average of the amplitude response values.

The methods may further include determining the composite response curve based on a weighted average of the amplitude response values, including weighting amplitude response values measured from at least one of the plurality of measurement locations in relation to a distance between a reference location and the location of the at least one measurement location.

The measurement locations may correspond to locations along a reference plane substantially parallel to a sound emitting side of a headphone earpiece and the reference location may correspond to a location along the reference plane.

The methods may further include weighting the amplitude response values measured from the at least one measurement location in relation to a distance between the corresponding reference location and the corresponding location of the at least one measurement location.

The reference location may correspond to one of an anatomical structure of an ear or a location of the sound emitting side of the headphone earpiece such as an ear canal or the center of the sound emitting side of the headphone earpiece.

The methods may further include emphasizes amplitude response values measured from measurement locations corresponding to locations on the reference plane that at least partially overlap with the reference location.

The methods may further include deemphasizes amplitude response values measured from measurement locations corresponding to locations on the reference plane that do not overlap with the reference location.

The methods may further include determining inverse filter parameters based on the determined composite response curve.

The methods may further include placing a microphone or microphone array at the plurality of measurement locations, driving a headphone transducer with a test signal for emitting one or more acoustic signals, and measuring, with the microphone or the microphone array, the emitted acoustic signal from the plurality of measurement locations.

The methods may further include coupling together the sound emitting side of the headphone earpiece and a headphone-microphone interface, wherein the interface including a plurality of microphone capsules at the plurality of measurement locations.

The methods may further include determining an area of the sound emitting side of the headphone earpiece physically or acoustically coupled to the headphone-microphone interface, and determining the reference location based on the determined area.

The determined reference location may correspond to the center of the determined area.

The methods may further include mapping one or more ear anatomical structures to the reference plane based on the determined area, wherein determining the reference location comprises assigning the reference location to one of the mapped ear anatomical structures.

The methods may further include moving the sound emitting side of the headphone earpiece along the headphone-microphone interface such that the microphone or the microphone array occupy the plurality of measurement locations.

The methods may further include measuring for one or more of phase, distortion, and impulse response.

The methods may further include determining if one or more amplitude response values equal or exceed an amplitude distortion value threshold, and omitting the determined one or more amplitude response values from the weighted average of amplitude response values.

Headphone may be one of a circumaural headphone, a supra-aural headphone, or an earbud.

Some embodiments provide methods for determining an equalization filter for headphones. The methods include receiving a first data that characterizes the acoustic response of the headphones, determining the equalization filter based on the first data, wherein the first data reflects a composite response curve based on an average of amplitude response values measured from a plurality of measurement locations, the plurality of measurement locations, in cumulative, substantially spanning at least a headphone transducer.

The methods may further include receiving second data that characterizes the acoustic response of an electro-acoustic device, wherein determining the equalization filter comprises determining the equalization filter based on the first and second data.

The electro-acoustic device may be one of a second headphone, a loudspeaker, and a guitar amplifier.

Second data may reflects a second composite response curve based on based on a second average of amplitude response values measured from a second plurality of measurement locations, the plurality of measurement locations, in cumulative, substantially spanning at least a headphone transducer of the second headphone.

The methods may further include receiving second data that characterizes the acoustic response of a studio mixing room or reflects a mastering curve and determining the equalization filter based on the first and second data.

The methods may further include extracting the second data from a media file.

The first data may include first filter coefficients that correct the acoustic response of the headphone and the second data may include second filter coefficients.

The methods may further include receiving the first data comprises reading a barcode. The barcode may include barcode-encoded first data or a barcode-encoded electronic address of the first data.

The methods may further include transmitting the first data or an electronic address of the first data to a playback device.

The methods may further include detecting a connection between the headphone and the playback device.

Some embodiments provide audio playback systems. The systems include an equalization module configured to receive a first data that characterizes the acoustic response of the headphone, configure an equalization filter based on the first data, wherein the first data reflects a composite response curve based on an average of amplitude response values measured from a plurality of measurement locations, the plurality of measurement locations, in cumulative, substantially spanning at least a headphone transducer.

The equalization module may be further configured to perform various functions as described below and in the appended claims.

Some embodiments provide systems further including a barcode reader, wherein the system is configured decode barcode-encoded first data or a barcode-encoded electronic address of the first data.

The systems may be further configured to detect a connection between the headphone and a playback device.

The system may be further include headphone with circuitry operable to transmit the first data or an electronic address of the first data.

Some embodiments provide further methods of determining an equalization filter for headphones. The methods include receiving first data that characterizes the acoustic response of the headphones, receiving second data that reflects a mastering curve or characterizes the acoustic response of another headphone, and determining the equalization filter based on the first data and the second data.

The methods may further include extracting the second data from a media file, wherein the second data includes one of a studio EQ profile, a song EQ profile, or an album EQ profile.

The studio profile may comprise data characterizing the acoustic room response of a particular studio room, the song EQ profile may comprise data comprises data reflecting a first mastering curve for a particular media file, and the album EQ profile may comprise data comprises data reflecting a second mastering curve for a particular group of media files.

The first mastering curve may be generated specifically for the particular media file and the second mastering curve may be generated specifically for the particular group of media files.

Some embodiments provide further audio playback systems including an equalization module configured to receive first data that characterizes the acoustic response of the headphones, receive second data that reflects a mastering curve or characterizes the acoustic response of another headphone and configure an equalization filter based on the first data and second data.

DETAILED DESCRIPTION

Figure 1:
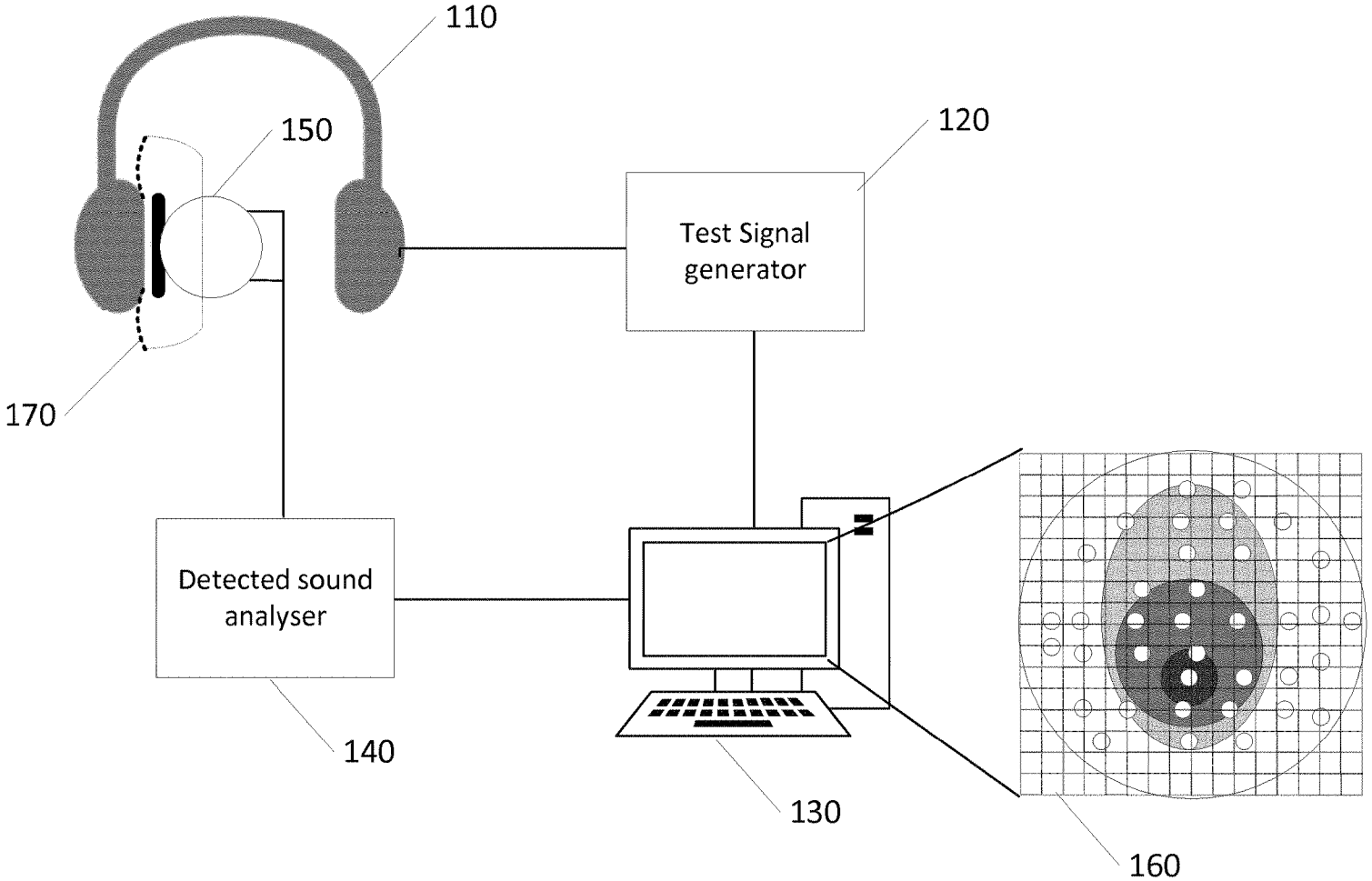
FIG. 1 shows the schematic diagram of block diagram according to one audio system embodiment.

One goal of headphone construction is improving the perceived audio quality, including refinements in the reproducibility and accuracy of reproducing an electronic audio signal as an acoustic audio signal (sound). The perceived quality of the acoustic audio signal produced by headphones may be characterized by a transducer's frequency response curve.

For example, in the AES paper, *The Relationship between Perception and Measurement of Headphone Sound Quality* (Olive, Sean; Welti, Todd; October 2012, AES Conv. No. 133, Paper No. 8744), the most preferred headphones by trained listeners had the smoothest and flattest amplitude response vis-à-vis other headphones when measured using an acoustic coupler. Such headphones, however, are prohibitively expensive for most users.

The present invention is partly based on the insight that present frequency response curve measurement techniques and applications thereof are inadequate. To explain further, the diversity of headphone types results in variations in the frequency response between different makes and models of headphones. This is due in part to the variety of headphone design types, such as open-back, closed-back, semi-open, supra-aural (on-ear), circumaural (over-ear), earbud (small headphones, typically wedged between outer ear anatomical features, facing but not inside the ear canal), and in-ear (inserted in the ear canal) as well as signal complexity types such as mono, stereo, or surround sound headphones.

Further, different headphone makes and models are constructed using a large variety electro-acoustic transducer technologies and accompanying enclosures.

Further still, the materials and geometries for constructing headphones and components (e.g. headphone casing, shell elements, and protective fabric) contribute to nonlinearities in the frequency response between different makes and models of headphones, including the degree and particular frequency of various self-resonant frequencies of the headphone and/or the headphone-ear interface.

Particular problems noted by the inventors include resonances along the non-transmitting side of transducers and other self-resonances.

Design modifications may correct for one non-linearity or increase performance (e.g., transient response), but may also introduce other unwanted effects (e.g., loss of low-frequency response).

The inventors have discovered that the measured frequency response not only changes at different measurement location due to the above reasons, but by utilizing multiple measurement locations, these nonlinearities can be accounted for. Thus, a more accurate frequency response curve can be determined for all headphone types utilizing filters calculated using the described methods and apparatuses. For example, amplitude response values obtained at the multiple measurement locations can be used to calculate, for example, filter parameters for an equalization filter.

Such filter parameters take into account distortions and nonlinearities that are locally measured, for example, along a plane parallel to the headphone transducer or, more generally, a plane parallel to the sound emitting side of the headphone earpiece.

Up to this point, a technical bias held that the only legitimate place to measure acoustic parameters of headphones was at the eardrum (or a location corresponding thereto). The present inventions depart from the conventional wisdom.

As used herein, acoustic parameters include amplitude response, impulse response, phase, and distortion (e.g., frequency, harmonic and phase distortion) measurement data. Said measurement data may include, for example, amplitude response values with respect to frequency (e.g., measurement data includes measured output magnitude/amplitude as a function of frequency). A test signal used to obtain the acoustic parameters may be, for example, a white or weighted noise (e.g., pink noise), an impulse, and/or a chirp or other frequency sweep.

Weighting, as used herein, results in emphasizing certain acoustic parameter contributions to, for example, a composite response curve based on a weighted sum of the measured acoustic parameter values. For example, a composite response curve may be fully determined by a weighted average of the amplitude response values measured from a plurality of measurement locations. The composite response curve may include further components and thus be partially determined by the weighted average.

A weighted summation may be accomplished by emphasizing and/or de-emphasizing the contribution of one or more of acoustic parameters obtained at particular measurement locations, as explained in detail below.

Amplitude response values include measured amplitude values at particular frequencies (e.g., measured amplitude response of a headphone).

Test signals include signals for driving headphone transducers include signals used for determining amplitude response values, impulse response values, and distortion values, as well as isolation response values (e.g., frequency-dependent measurements of a headphone earpiece blocking/isolating sound external to the headphone).

Digital equalization filter parameters include parameters that reflect or correct for the acoustic response of a studio mixing room, studio mixing monitors, or both (e.g., a composite response curve of the two response curves that characterize or correct). The digital EQ filter parameters may determine an EQ filter frequency response.

Data or parameters may characterize the acoustic response of a headphone in at least two ways. First, data or parameters may reflect a response curve in the sense that said data or parameters are determined at least partly based on values along the response curve showing a headphone's measured amplitude response with respect to frequency (e.g., parameters that track the amplitude response curve).

Second, parameters may configure, for example, a graphic equalizer such that the amplitude response of the equalizer is an inverse response curve of a headphone's measured amplitude response. That is, parameters may characterize a headphone's measured amplitude response via an inverse relationship with said measured amplitude response (e.g., parameters that track a correction curve).

Digital EQ filter parameters may set such variables as center frequency, bandwidth, and gain of one or more filters. There are known techniques for generating filter coefficients based on center frequency, bandwidth, Q, and gain values. Digital EQ parameters may include digital filter coefficients. Digital EQ parameters may include codebook values indexing one or more parameter values (e.g., vector encoded parameter values). Digital EQ filter parameters may be parameters for FIR and/or IIR filters.

Digital equalization filter parameters may reflect a mastering curve. For example, a mastering curve may include an equalization curve created during the recording or mixing process. The mastering curve may reflect a reference spectral balance if created using accurate monitors (e.g., near flat frequency response) in an acoustically treated room or headphones with a near flat frequency response.

The above filter parameters, however generated, may be included in a studio EQ profile, a song EQ profile, or an album EQ profile, as discussed below. Unless noted otherwise, every mention of "studio EQ profile" or "studio profile", also includes embodiments with a song or album EQ profile.

A headphone profile may include digital equalization filter parameters that characterizes the acoustic response of a particular model of headphones.

Using, for example, the studio and headphone profiles, an EQ filter may be generated for each track or album audio file(s) (e.g., MP3, WAV) and for the specific headphone. For example, a signal processor may generate an EQ filter or filter parameters based on the studio and headphone profiles.

To explain further, a mastering curve may be generated for a particular audio track or album reflecting a reference spectral balance. This data may be included in the corresponding audio file. Thus, a song EQ profile or an album EQ profile may include mastering curves particular to the associated song or album.

Thus, a composite EQ curve may be generated which better reflects the spectral balance heard when the mastering curve was created over a reference system. That is, nonlinearities of the headphone may be corrected via, for example, the headphone profile, which allows for the mastering curve to not alter the audio signal over headphones with an unknown frequency response and resonances, but rather vis-à-vis a corrected, near-flat headphone response.

A studio EQ profile may characterize the acoustic space of the mixing room environment with, for example, a response curve. A studio profile may be combined with a headphone profile so to reflect the acoustic signature of the mixing room. That is, the studio profile may be one of data that reflects the acoustic space of the mixing room.

The EQ filter may reflect a composite curve of the studio and headphone profiles or two filters may be used respectively reflecting the studio and headphone profiles, wherein the audio is process through both filters. The EQ filter may be implemented as FIR or IIR filters and may include a parametric or graphic EQ filter.

The EQ filter may reflect a composite curve of a headphone profile and a profile for another electro-acoustic device or two filters may be used respectively reflecting the headphone and another electro-acoustic device profiles, wherein the audio is process through both filters. The EQ filter may be implemented as FIR or IIR filters and may include a parametric or graphic EQ filter.

As used herein, an EQ filter may include a plurality of filters. For example, a graphic EQ filter may be implemented via a set of filters.

As one example, a playback app may apply a studio profile to the audio signal and a general audio app (with EQ processing capabilities) processes the audio signal outputted from the playback app with the headphone profile.

The audio processing (e.g., implementing an EQ filter) may be accomplished by an application running on a smartphone or other playback device (computer, MP3 player, etc). The audio processing may be accomplished by a dedicated digital signal processing chip interfacing with other software or hardware components.

The playback device may use a camera to capture a 1D or 2D barcode on the headphone or headphone packaging as a step in obtaining the headphone profile or an address of the headphone profile such as an URL. The barcode may additionally or alternatively encode the EQ filter parameters themselves. Such embodiments may further include setting a digital EQ filter to the values encoded on the barcode, as determined by the information decoded from the 1D or 2D barcode.

Additionally or alternatively, the playback device may obtain the headphone profile or address by near-field communication such as Bluetooth or radio frequency identification tags. For example, a Bluetooth-enabled headphone may transmit the headphone profile. The headphone profile may similarly be transmitted over wired means (e.g., USB headphones).

A database may store and provide a plurality of headphone profiles.

The studio profile may be distributed along with the song files purchased from an internet consumer retail source. For example, a user registered with a digital music service may provide the make and model of the headphones to be used. EQ filter parameters or the headphone profile may accompany a music file for processing said music file via an EQ filter processing audio of the playback device (e.g., via a music streaming app or a general audio app with EQ processing capabilities).

The playback device may communicate over the internet with a database to retrieve the studio and/or headphone profiles.

In accordance with another embodiment, the headphone profile may contain several generic EQ filter parameter files associate with different headphone designs such as in-ear headphone (earphone), and open and closed headphones.

System Overview

FIG. 1 shows the schematic diagram of block diagram according to one audio system embodiment. In particular, FIG. 1 schematically represents a number of possible different scenarios.

The headphones 110 are connected to a test signal generator 120, which generates a test signal. In some embodiments, computer 130 may be a dedicated digital audio workstation. In some embodiments, computer 130 may control both the test signal generator 120 and the detected sound analyser 140. In some embodiments, the operations performed by modules 120 and 140 may be performed by computer 130.

A microphone 150 captures an acoustic measurement for generating acoustic parameters. The microphone 150 may be a calibrated measurement microphone. Microphone 150 may also include a microphone array or an array of microphone capsules, thus allowing for the possibility of measuring at multiple measuring points at the same time. The microphone 150 may be a MEMS-based microphone.

The microphone 150 may be placed in multiple positions to collect information for determining a measured amplitude response and/or equalization filter or filter parameters. The data may be collected and saved during the process of transmitting a test audio signal to the headphones 110.

The microphone may be placed, for example, at different measurement locations corresponding to different sections along a sound emitting side of a headphone earpiece, wherein the measurement locations may, in cumulative, span at least the headphone transducer or the sound emitting side of a headphone earpiece. The measurement locations may correspond to a particular section of the sound emitting side of a headphone earpiece and/or an anatomical structure of an ear mapped to a reference plane. In some embodiments, a notational or actual reference plane may be defined.

In general, "corresponding" means measurement locations that lay on one side of a sound emitting side of a headphone earpiece or a reference plane, or on the reference plane itself, and share x and y plane coordinates with, for example, a section of the sound emitting side of a headphone earpiece or an anatomical structure of an ear mapped to the reference plane.

Thus, microphone capsules arranged at the measurement locations may be positioned at different z coordinates than the "corresponding" section or structure with respect to the reference plane, but nevertheless the locations and section/structure may align with a notational line perpendicular with the reference plane.

The reference plane may be a notional (virtual) construct or, in the case of some headphone-microphone interface embodiments, an actual entity (e.g., the surface of interface 510). The reference plane may be substantially parallel to microphone capsules, a headphone transducer, and/or the sound emitting side of a headphone earpiece.

Embodiments also include obtaining multiple measurements at a same location, per unique measurement location. For example, different test signals can be generated for measuring different acoustic parameters while a microphone remains at a measurement location.

The multiple measurement locations may correspond with anatomical ear structures such as pinna and the ear canal. A plurality of amplitude response values may be weighted with respect to a distance from the ear canal for determining, for example, a weighted average of the amplitude response curves. The amplitude response values measured from the measurement location closest to the ear canal may be emphasized over measurement locations further away. "Further away" may be with respect to the xy-coordinates of the reference plane.

Computer 130 may display a user interface 160, which shows the different measurement locations, as mapped to the reference plane, e.g., the locations on the reference plane corresponding to the measurement locations. A user interface module may guide a user graphically to place the microphone at a corresponding place shown by the user interface 160. For example, the smallest, darkest circle shown by user interface 160 may correspond to an area of the headphone transducer that is directly across an ear canal when worn. The user interface 160 may guide the user to move microphone 150 and/or headphones 110 to the (approximate) positions that correspond with a present or future measurement location.

In alternative embodiments, the user selects or inputs the corresponding location of where the microphone is located or a weight to apply to the amplitude response values of a particular measurement location. This may be accomplished using the user interface 160, e.g., clicking on a quadrant or a weighting location (e.g., the concentric circles), as explained in detail with FIG. 2*a*.

As will be further explained below, the microphone may be stationary while the headphone transducer is moved or tilted with respect to the reference plane, and thus achieve a similar effect as moving a microphone (e.g., measuring a plurality of measurement locations to obtain amplitude response values measured with respect to a reference plane substantially parallel to the sound emitting side of the headphone earpiece).

In either case, the microphone 150 and/or headphones 110 may be manually moved by a user. In some embodiments, a user may move microphone 150 and/or headphones 110 using a guide, which shows where a user should place, for example, the headphones 110.

The guide and user interface 160 may have corresponding coordinate systems or grids, such that a user may easily position the microphone 150 and/or headphones 110 to location shown by the user interface 160. For example, headphone-microphone interface 170 may have a guide shown graphically on its surface similar to the graph shown in user interface 160. Thus, a user may orient the sound emitting side of the headphone earpiece to align with the guide on the headphone-microphone interface 170. The surface of the headphone-microphone interface 170 may physically or acoustically couple to the sound emitting side of the headphone earpiece.

However the microphone 150 and/or headphones 110 are placed or moved, the measured amplitude values may be recorded and may be combined to produce a composite response curve.

Figure 2B:
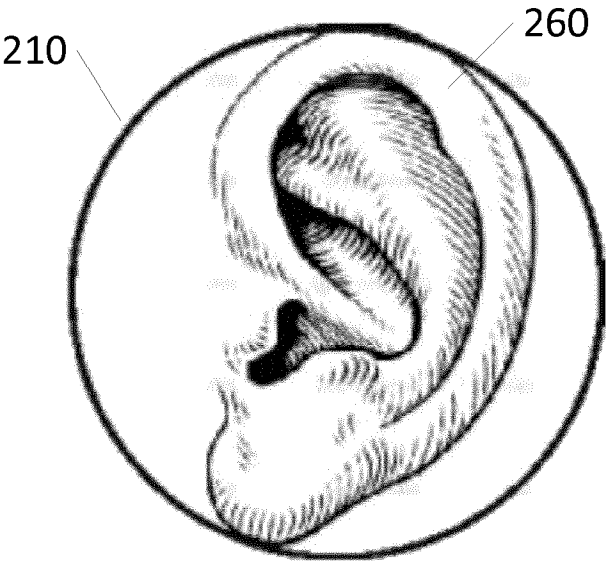
FIGS. 2*a* and 2*b* illustrate one embodiment aspect, which show measurement locations corresponding to different locations along a reference plane.
Figure 2A:
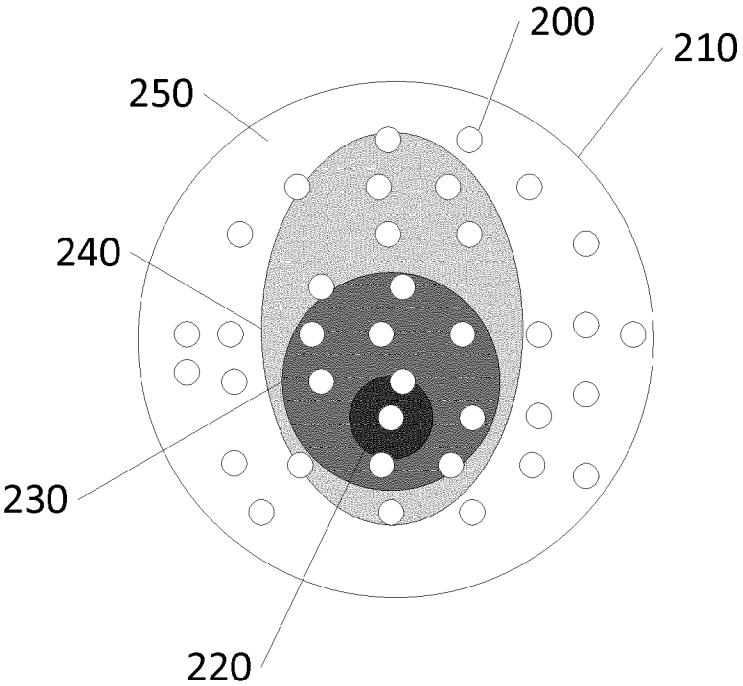

FIGS. 2*a* and 2*b* illustrates one embodiment aspect, which show measurement locations corresponding to different locations along a reference plane between a headphone transducer and said measurement locations, wherein a human ear 260 is mapped to the reference plane 210, as a reference for FIG. 2*a*. FIG. 2*a* is also an enlarged version of the user interface 160 shown in FIG. 1, without the grid.

The measurement locations 200 may span the entire or substantially the entire circumference or area of a headphone transducer or the sound emitting side of the headphone earpiece. In this example, reference plane 210 encapsulates, two-dimensionally, the entire sound emitting side of a headphone earpiece. For example, said headphone earpiece may include the transducer as well as ear pads that lie on or around an ear. A headphone earpiece typically includes at least a transducer, ear pad or ear canal insert, and housing (e.g., headphone shell) attached to the ear pads or inserts and housing the transducer.

An equalization curve, filter, or filter parameters may be determined based on the amplitude response values obtained from the measurement locations 200. For example, amplitude response values may be a weighted combination to produce a composite response curve. Embodiments also include non-weighted averaging of amplitude response values to produce a composite response curve.

The measurement locations 200 may be weighted according to the distance away from the ear canal, which is shown by weighting areas 220, 230, 240, and 250. For example, measurements within weighting area 220 are assigned to provide a proportionally greater contribution to the composite response curve than measurements within the weighting areas 230, 240, and 250.

The same may be true of weighting area 230 in relation to area 240 and weighting area 240 in relation to area 250. As an example, weighting areas 220, 230, 240, and 250 can be assigned a value between 0 and 1 for weighting amplitude values with corresponding measurement locations overlapping weighting areas 220, 230, 240, or 250.

That is, one inventive insight of the present invention is that measurements can be differentiated by their importance or priority partly because the emitted test signal radiated directly opposite the ear canal reaches the inner ear with minimal reflection, whereas measurement locations within weighting areas 230, 240 and 250 correspond to radiated acoustic signals that bounce against the outer ear and headphone shell, thereby losing acoustic energy by the time the signal reaches the ear drum, but nevertheless contributing to the sound perceived by a listener.

Figure 3:
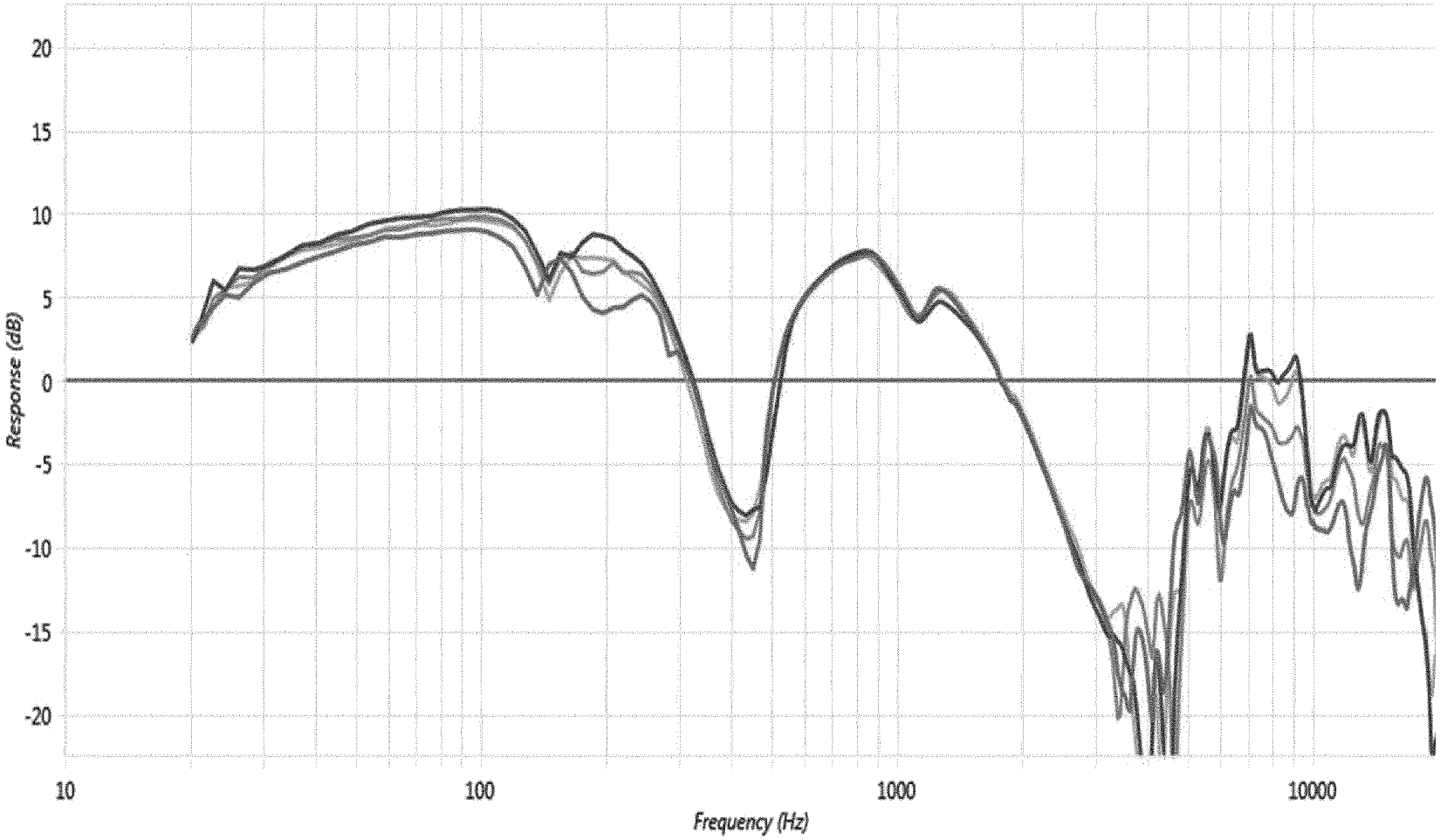
FIG. 3 illustrates frequency response curves associated with measurement locations corresponding to locations along a sound emitting side of a headphone earpiece.

This can be seen in FIG. 3, which shows frequency response curves respectively showing amplitude response values measured from different measurement locations. In particular, the curves differ significantly within the mid- to high-frequency bands.

Figure 4:
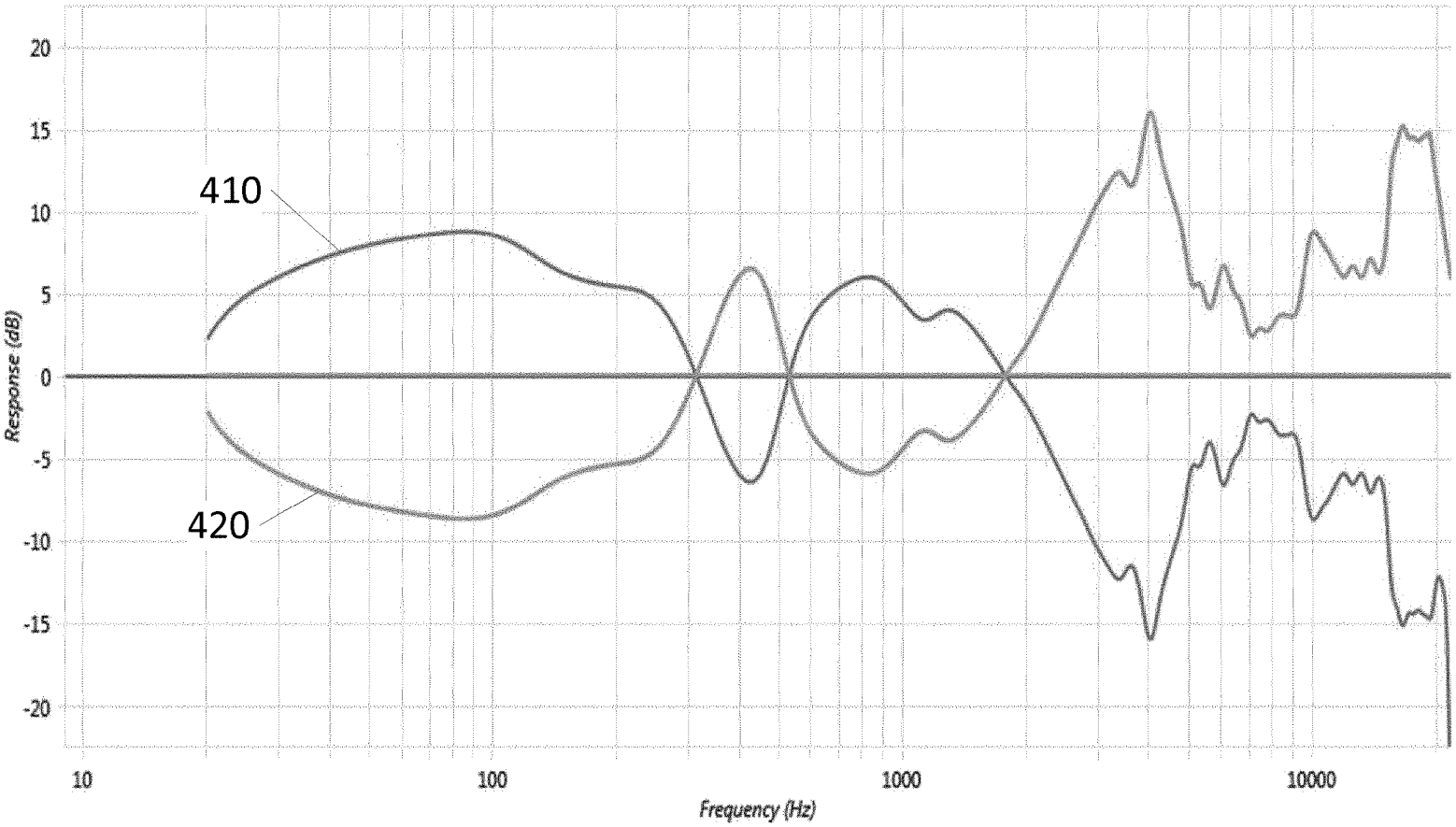
FIG. 4 shows a composite response curve of the curves shown in FIG. 3 and an inverse composite response curve.

Composite response curve 410 shown in FIG. 4 shows the weighted combination of the curves shown in FIG. 3. Inverse composite response curve 420 shows one possible representation of a headphone equalization filter, which is the inverse of curve 410. Equalization parameters based on curve 420 may be applied to an audio signal, including parameters being implemented in an equalization filter such as a FIR or IIR filter.

The frequency resolution of said parameters may vary, i.e., the number of Hertz per applied parameter. One skilled in the art is aware of several techniques of applying a response curve and characteristics thereof to an audio signal, e.g., filtering in the analog and digital domains.

Measurement Apparatuses

Figure 5A:
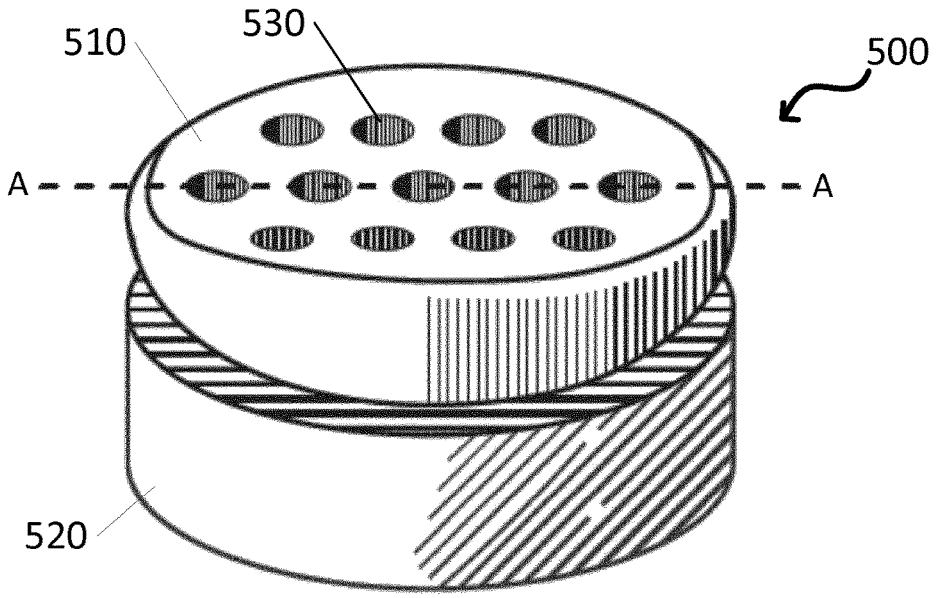
FIGS. 5*a* to 5*e* show apparatus embodiments for measuring acoustic parameters of a headphone in relation to a reference location.
Figure 5B:
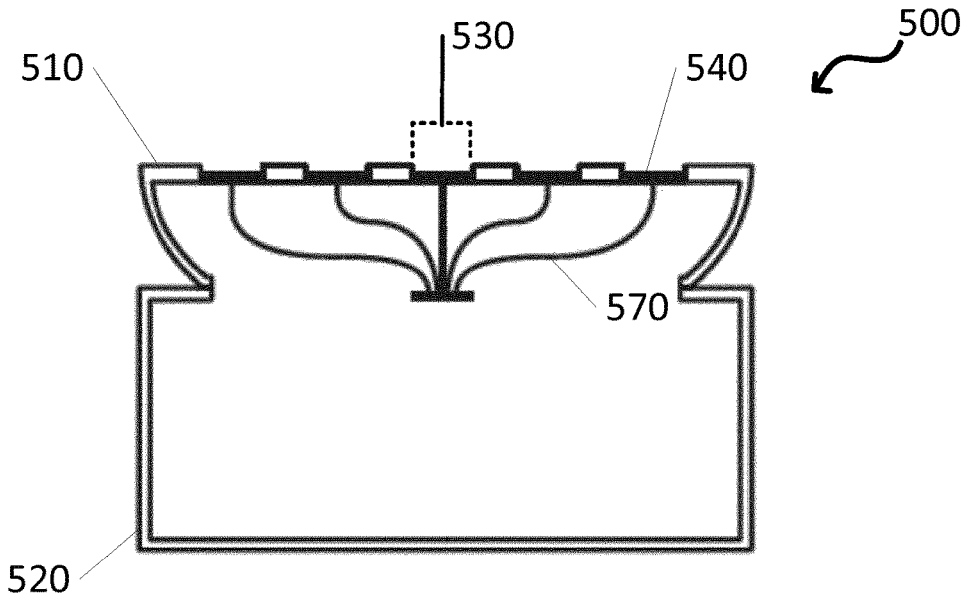
Figure 5C:
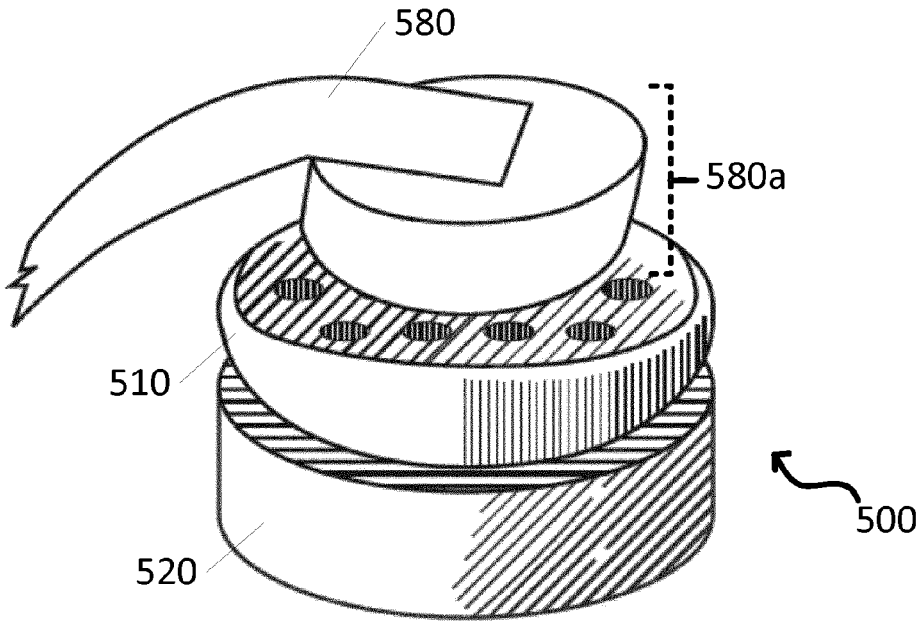
Figure 5D:
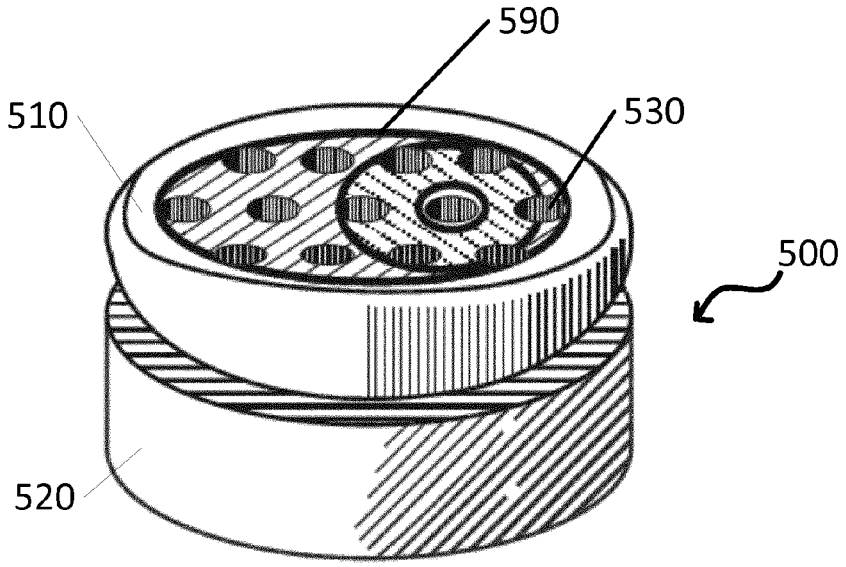
Figure 5E:
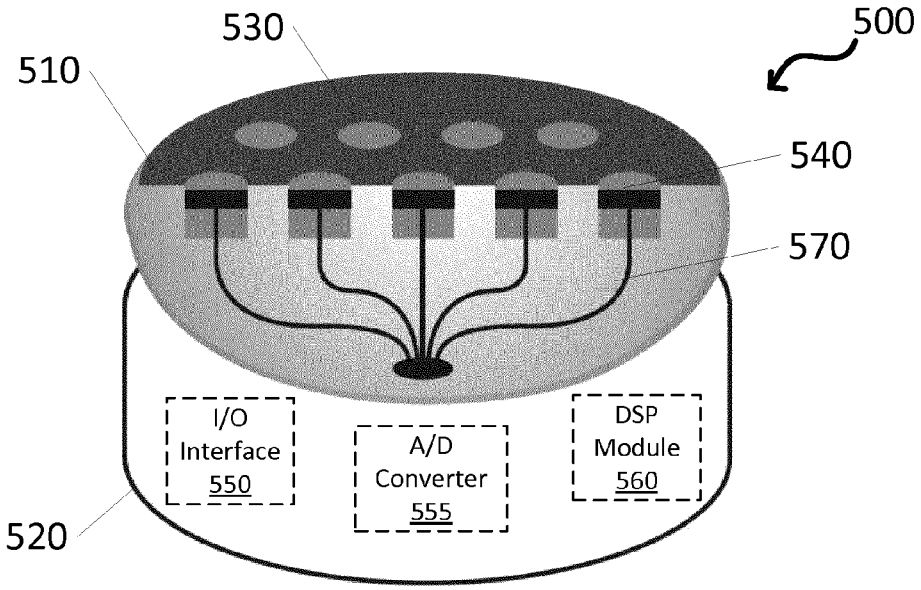

FIGS. 5*a* to 5*e* show apparatus embodiments for measuring acoustic parameters of a headphone in relation to a reference location. FIG. 5*b* is a cross-section of apparatus 500, taken along line A of FIG. 5*a*. FIG. 5*e* is a schematic partially cut-away isometric view of the apparatus 500 of FIG. 5*a*.

Apparatus 500 includes a headphone-microphone interface 510 and base 520. Interface 510 and base 520 may be integral or two or more discrete pieces. The surface of interface 510 is substantially flat, but may also be curved, as shown in other embodiments. Interface 510 may also be shaped similar to a human ear that includes holes 530. Embodiments also include variations without base 520 (e.g., an apparatus that include a headphone-microphone interface 510 and a plurality of microphones or microphone capsules placed in or along the headphone-microphone interface 510).

The surface of interface 510 defines a plurality of holes 530 arranged along a surface of the interface at several distances, measured along the reference plane, away from a location on the surface corresponding to the reference location. The surface of the interface 510 is for coupling with a sound emitting side of a headphone earpiece, as shown in FIG. 5*c*.

The holes 530 house a plurality of microphone capsules 540. The holes 530 may be arranged in particular patterns with respect to a reference location residing on the surface of interface 510. These patterns may be formed by groups of holes aligned in geometric shapes that are concentric to the reference location.

Holes 530 demonstrate one technique of arranging microphone capsules 540 at the plurality of measurement locations. Other techniques include embedding microphone capsules 540 within the surface of interface 510 or attaching microphone capsules on the surface of interface 510.

Interface 510 may comprise a sound-absorbing material that reduces local resonances in the mid and upper frequency ranges (e.g., 5 hz to 22 khz). The material may be an elastomeric or elastomeric-like material or materials with sound absorption and reflection similar to skin.

Wires 570 may extend externally from apparatus 500 and may terminate with an XLR connector, ¼ or ⅛ inch jack (e.g., a phone connector), or a connector interfacing multiple channels with an external device such as a digital audio workstation.

Apparatus 500 may alternatively include I/O interface 550. I/O interface 550 may be a plurality of XLR or phone connectors or a connector interfacing multiple channels located on an exterior surface of base 520. One example of a multi-channel connector are the connects found in audio snake cables that serves as an interconnect for multiple channels of audio. Thus, for example, an audio snake cable may plug into the I/O interface 550 if configured as a multi-channel connector.

Apparatus 500 may also include analog-to-digital converter 555 and DSP module 560. By converting measured amplitude response values into the digital domain, I/O interface 550 may include interfaces suitable for carrying digital signals such as USB, HDMI, optical, and other interfaces. DSP module 560 may be configured to perform the signal processing techniques described in this description, including generating filter parameters.

I/O interface 550, A/D converter 555, and DSP module 560 are optional components, designated by the dashed lines.

FIG. 5*c* shows headphone 580 coupled to apparatus 500. In particular, the surface of interface 510 is coupled to a sound emitting side of a headphone earpiece 580.

Interface 510 of FIG. 5*d* further includes guide marks 590. Guide marks 590 may indicate, on the surface of the interface 510, the reference location or an area encompassing the reference location. For example, measured amplitude values measured from holes 530 overlapping with guide marks 590 may be weighted according to the technique described in reference to FIG. 2*a*. As used herein, "overlapping with" may be a partial overlap (e.g., a guide mark partially overlaps, with respect to the reference plane, a microphone capsule) or complete overlap (e.g., a guide mark encompasses, with respect to the reference plane, a microphone capsule).

At least one guide mark of guide marks 590 may be a two-dimensional geometric shape such as a circle, oval, or square. At least one guide mark of guide marks 590 may show at least one anatomical structure of an ear. The at least one anatomical structure may be an ear canal.

Guide marks 590 may graphically show an ear and assorted anatomical structure of the ear and be aligned similarly as the guide marks 590 are currently shown.

Apparatus 500 may further include the interface 510 with light or pressure sensors on the surface of the interface 510. Said sensors may be used to determine where on the interface 510 the headphone is located. For example, a headphone may block light from said light sensors and thus a contact area will at least roughly correspond to the light sensor detecting no or minimum light.

As will be explained in more detail below, the contact area may be determined using the acoustic signals. For example, measurement locations measuring signals below an amplitude threshold may be deemed outside of the contact or measurement area.

Figure 6A:
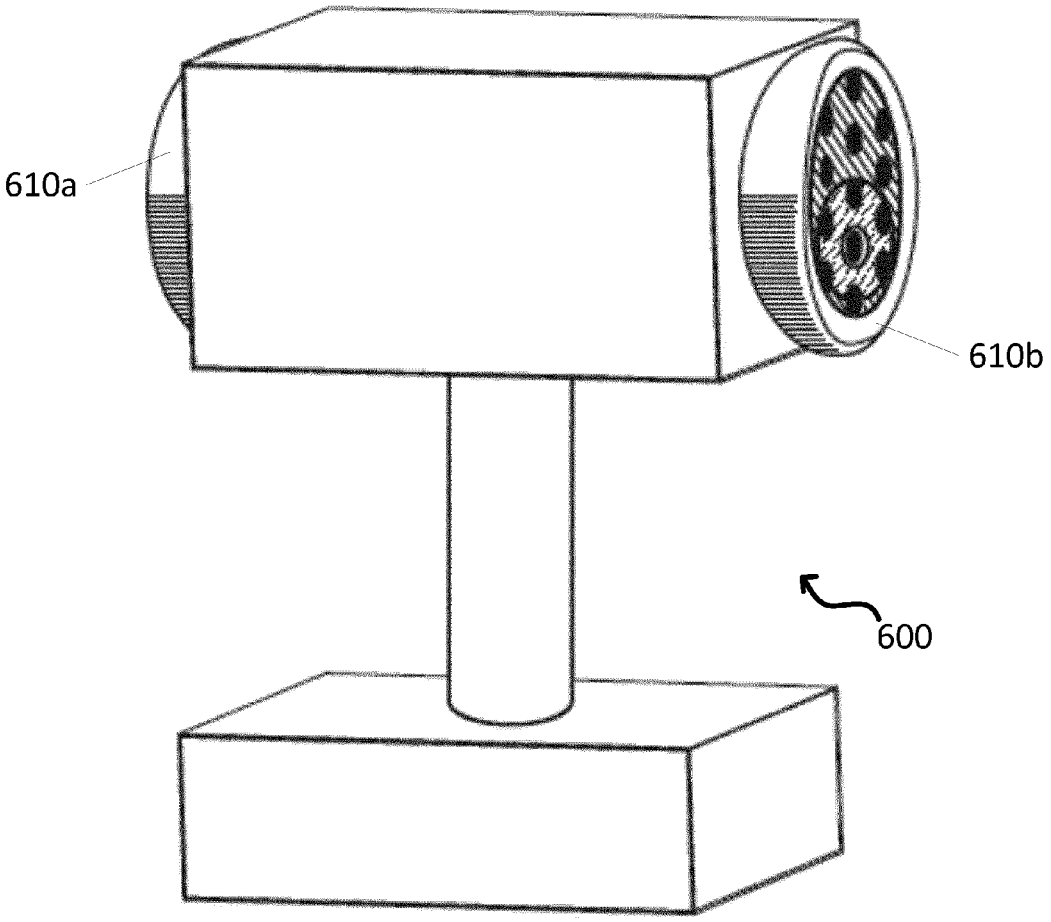
FIGS. 6*a* and 6*b* show an apparatus embodiment for measuring acoustic parameters of a headphone in relation to a reference location.
Figure 6B:
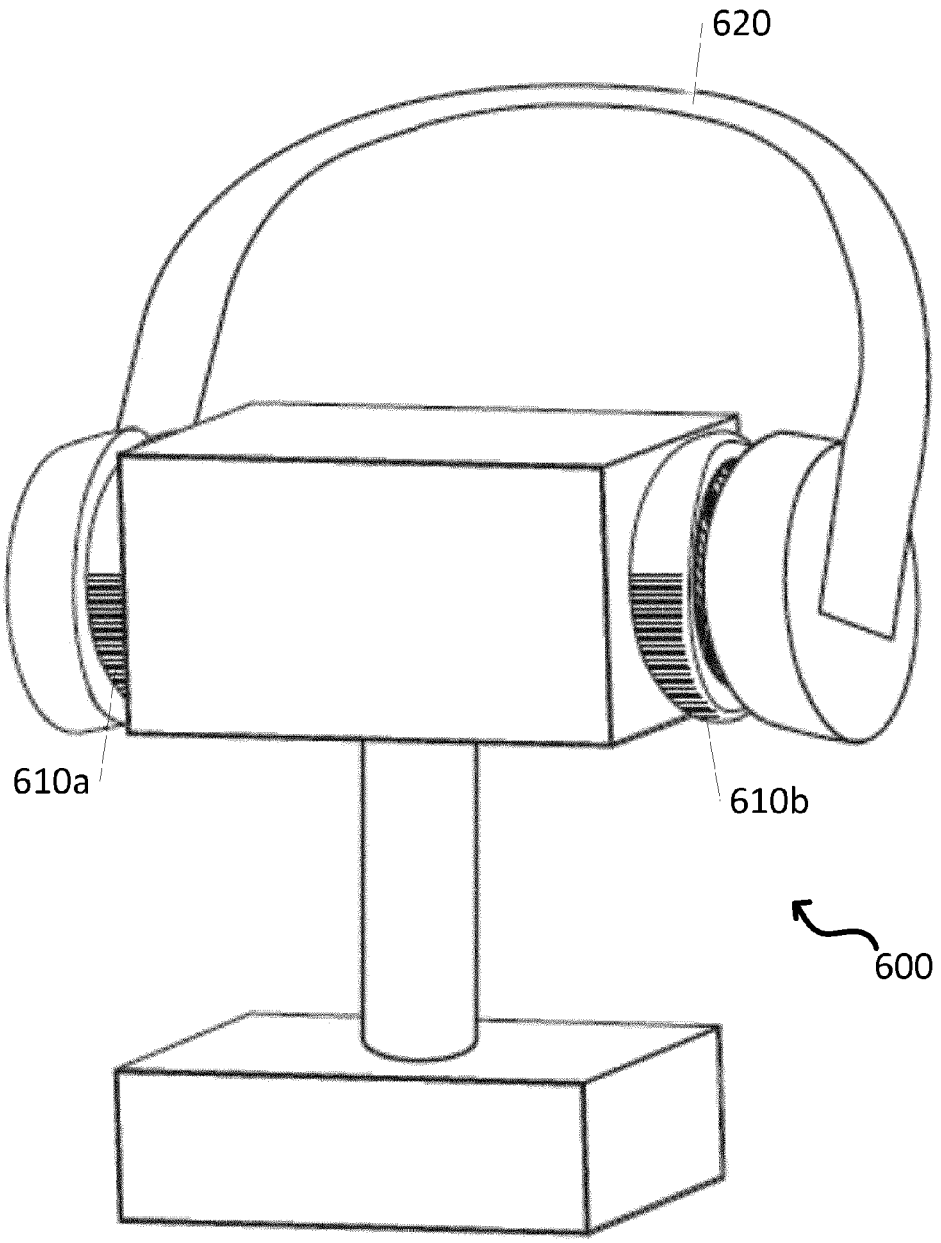

FIGS. 6*a* and 6*b* shows an apparatus embodiment for measuring acoustic parameters of a headphone in relation to a reference location. Test fixture 600 includes headphone-microphone interfaces 610*a* and 610*b*, which couple with headphone 620.

Interfaces 610*a* and 610*b* may include any of the above-described features of interface 510, including general shape (e.g., flat, curved, or human ear), inclusion of guide marks, and arrangement of holes.

Measurement Methods

Figure 7A:
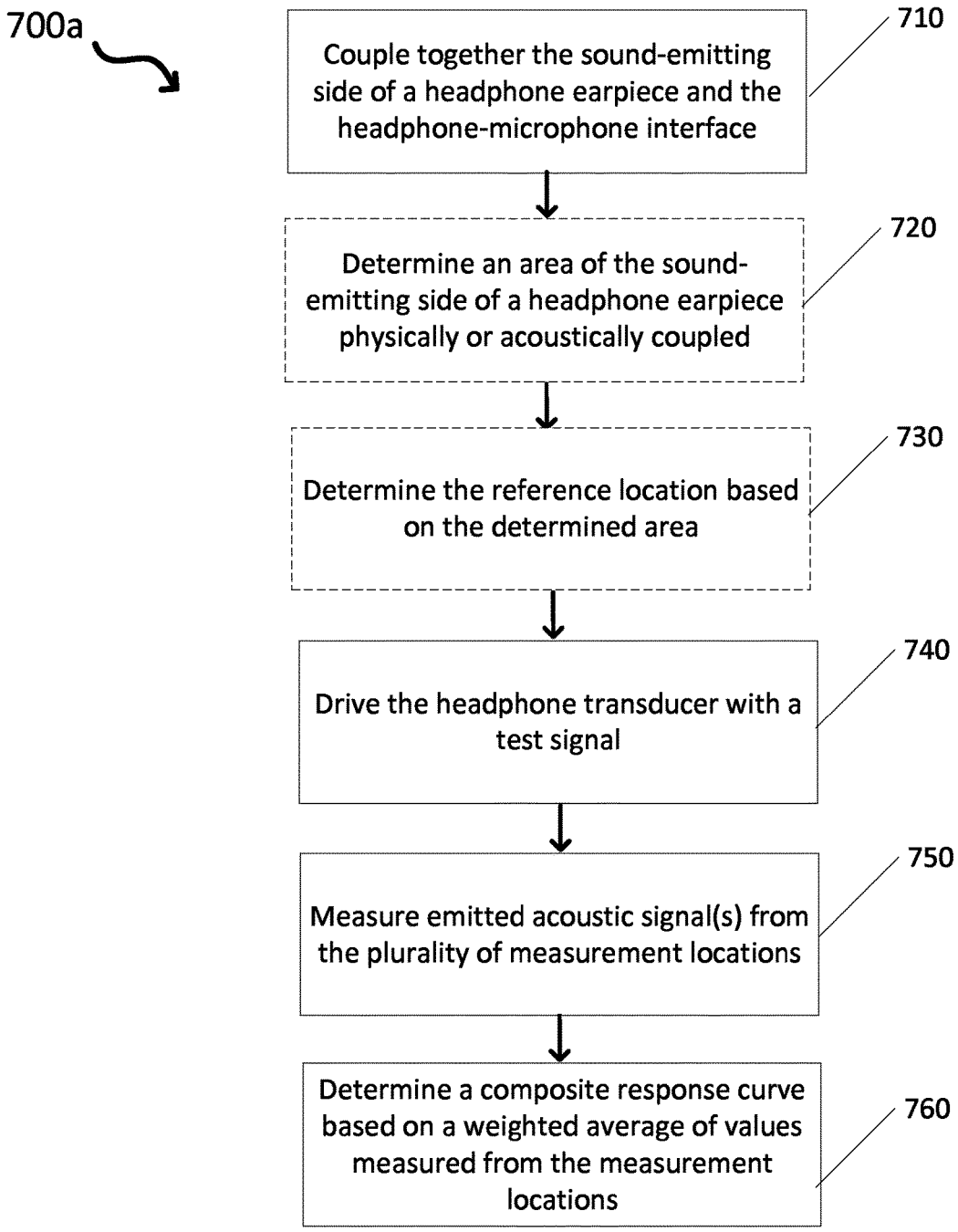
FIGS. 7*a* and 7*b* show embodiments method of measuring acoustic parameters of a headphone.

FIG. 7*a* shows an embodiment method of measuring acoustic parameters of a headphone in relation to a reference location of a reference plane using a headphone-microphone interface. Optional steps are shown with dashed lines.

At step 710, method 700*a* includes coupling together the sound emitting side of the headphone earpiece and a headphone-microphone interface. The surface of the interface may define the reference plane and reference locations corresponding thereto.

At step 720, determining an area of the sound emitting side of the headphone earpiece physically or acoustically coupled to the headphone-microphone interface. This may be accomplished using light or pressure sensors included on the interface or amplitude/distortion values measured from the measurement locations. For example, values at, under, or above an amplitude or distortion value threshold may be limited or discarded.

An area may be determined by determining which measurement locations provide sufficient amplitude/distortion values. These locations may span the determined area, whereas measurement locations providing insufficient amplitude/distortion values may be limited (e.g., reduced measured contributions) or excluded from the determined area.

At step 730, the reference location may be determined based on the determined area. The determined reference location corresponds to the center of the determined area. Step 730 may include mapping one or more ear anatomical structures to the reference plane based on the determined area, wherein determining the reference location comprises assigning the reference location to one of the mapped ear anatomical structures.

For example, the determined area may approximately resemble a circle on the interface. The reference location and/or ear anatomical structures may be mapped within the circle or at predetermined distances from the edge of the circle.

The reference location of the reference plane may have a predetermined distant relationship, measured along the reference plane, to the measurement locations.

Step 740 includes driving the headphone transducer with a test signal for emitting one or more acoustic signals.

Step 750 includes measuring the one or more emitted acoustic signals from a plurality of measurement locations to obtain amplitude response values measured from the measurement locations.

Step 760 includes determining a composite response curve based on a weighted average of the amplitude response values. Step 760 may include weighting amplitude response values measured from at least one of the plurality of measurement locations in relation to a distance between the reference location and the location on the reference plane corresponding to the measurement location of the at least one amplitude response value.

Figure 7B:
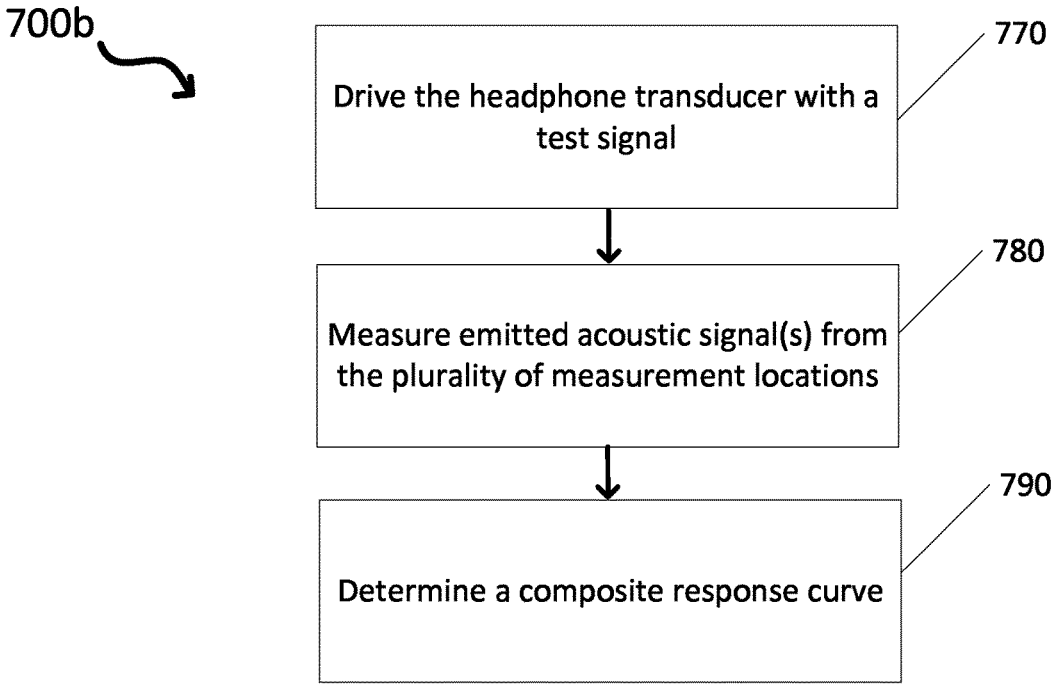

FIG. 7*b* shows an embodiment method of measuring acoustic parameters of a headphone.

At step 770, method 700*b* includes driving a headphone transducer with a test signal for emitting one or more acoustic signals.

Step 780 includes measuring the one or more emitted acoustic signals from a plurality of measurement locations to obtain amplitude response values measured from the measurement locations, the plurality of measurement locations, in cumulative, substantially spanning at least the headphone transducer, as discussed in reference to FIGS. 2*a* and 2*b*. This may be accomplished by moving the headphone, microphone(s), or both.

Step 790 determining a composite response curve based on the obtained amplitude response values. The composite response curve may be a weighted or non-weighted average of the obtained amplitude response values.

Measurement Apparatuses

Figure 8A:
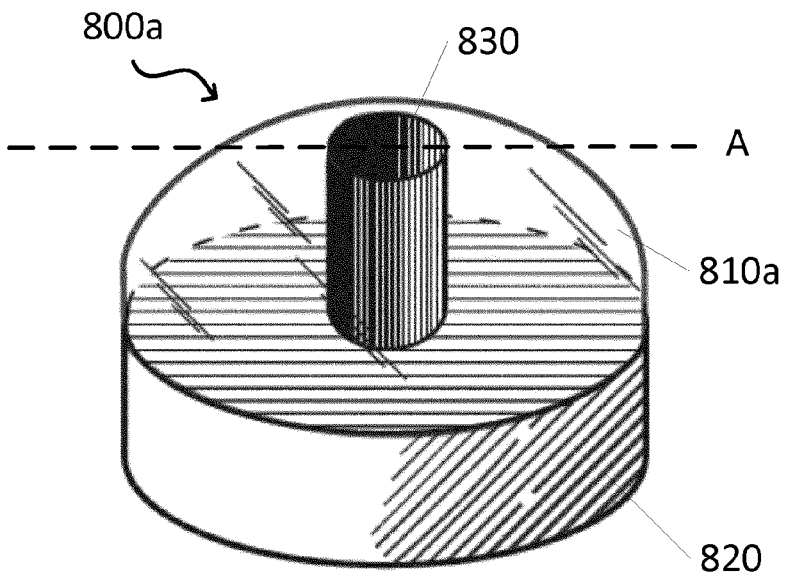
FIGS. 8*a* and 8*b* show apparatus embodiments for measuring acoustic parameters of a headphone in relation to a reference location.
Figure 8B:
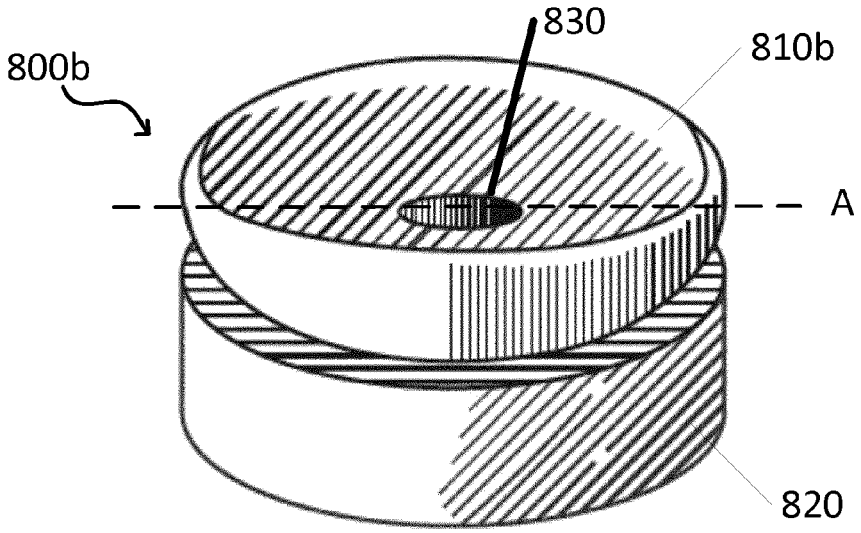

FIGS. 8*a* and 8*b* show apparatus embodiments for measuring acoustic parameters of a headphone in relation to a reference location.

Interfaces 810*a* and 810*b* may include any of the above-described features of interface 510, including guide marks and arrangement of holes, but are distinguished by the curved surface of interfaces 810*a* and 810*b*.

Interfaces 810*a* and 810*b*, as shown in FIGS. 8*a* and 8*b*, include hole 830 for housing a microphone or microphone capsule (not shown). Hole 830 may be one of a plurality of holes defined by interfaces 810*a* and 810*b*. In alternative embodiments, other techniques include embedding microphone capsules within the surface of interfaces 810*a* and 810*b* or attaching microphone capsules on the surface of interfaces 810*a* and 810*b*.

Apparatuses 800*a* and 800*b* include base 820. Base 820 may house A/D converter circuitry, DSP modules, and/or I/O interfaces. Embodiments include apparatuses 800*a* and 800*b* without base 820.

Figure 9A:
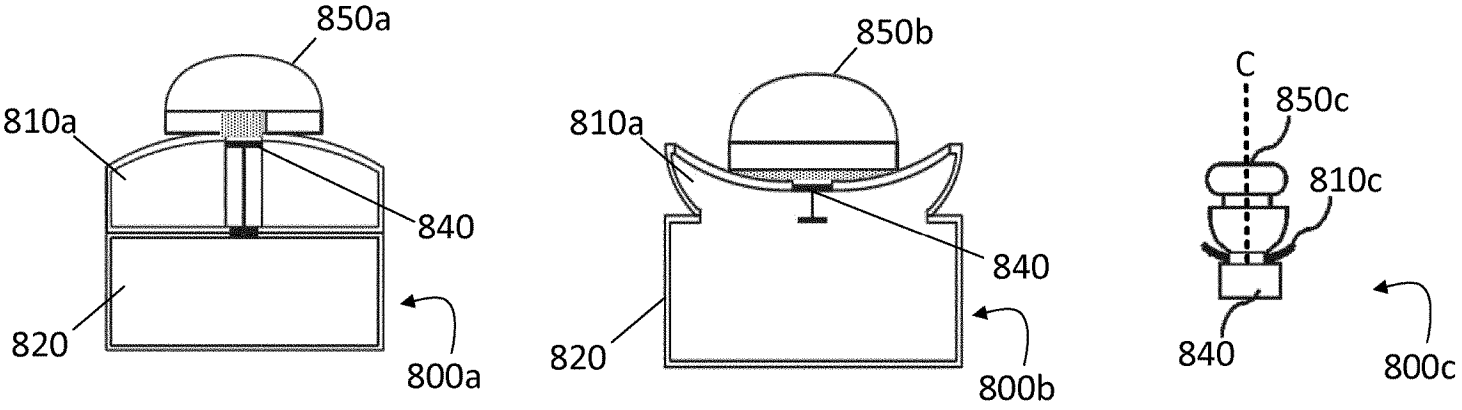
FIGS. 9*a* and 9*b* show apparatus embodiments for measuring acoustic parameters of a headphone in relation to a reference location.
Figure 9B:
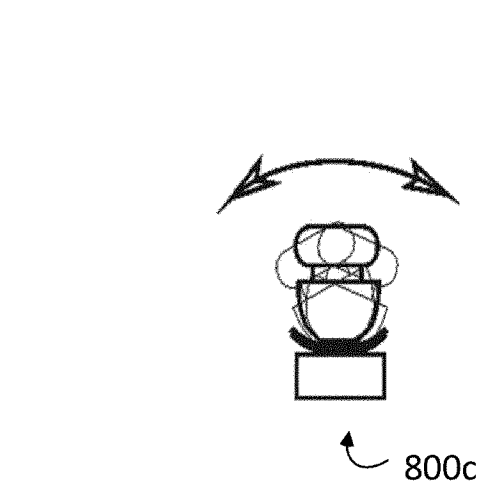

FIGS. 9*a* and 9*b* show apparatus embodiments for measuring acoustic parameters of a headphone in relation to a reference location. FIGS. 9*a* and 9*b* show a cross-section of apparatuses 800*a* and 800*b*, taken along line A of FIGS. 8*a* and 8*b*.

The apparatuses 800*a* to 800*c* enable measurement across a sound emitting side of headphone earpieces 850*a*, 850*b*, and 850*c* in relation to microphone 840. Apparatuses 800*a* to 800*c* may also partially define an acoustic space with the sound emitting side of headphone earpieces 850*a*, 850*b*, and 850*c*. This acoustic space is shown by the hatching pattern for apparatuses 800*a* and 800*b*.

The acoustic space may establish an acoustic impedance with headphone earpieces 850*a*, 850*b*, and 850*c* and define a volume in front of the electro-acoustic transducer of headphone earpieces 850*a*, 850*b*, and 850. This volume may partially model or simulate the volume created at the headphone-ear interface. In particular, this volume may be of a similar volume as that of a headphone-ear interface's volume (e.g., the volume defined between a human ear and the sound emitting side of headphone earpieces 850*a* or 850*b*). Interface 510 may also establish the same volume when coupled with the sound-emitting side of a headphone earpiece.

FIG. 9*b*, shows one way of placing microphone 840 at different measurement locations corresponding to different locations along the sound emitting side of headphone earpieces 850*a*, 850*b*, and 850*c*.

Microphone 840 remains stationary in relation to headphone earpieces 850*a* and 850*b*, which are slid or otherwise moved to different positions along interfaces 810*a* and 810*b*.

This movement provides for measurement locations with different sections of the headphone transducer radiating across from microphone 840.

Apparatus 800*c* is used to obtain a plurality of measurement locations by tilting headphone earpiece 850*c* with respect to central axis C, which is substantially perpendicular to the transducer of headphone earpiece 850*c*. Thus, apparatus 800*c* may be used to take measurements at different angles or orientations of headphone earpiece 850*c*.

Headphone earpiece 850*c* is a bud type headphone with a sound emitting side that interfaces with an ear canal, e.g., laying or entering the ear canal when worn.

Figure 10:
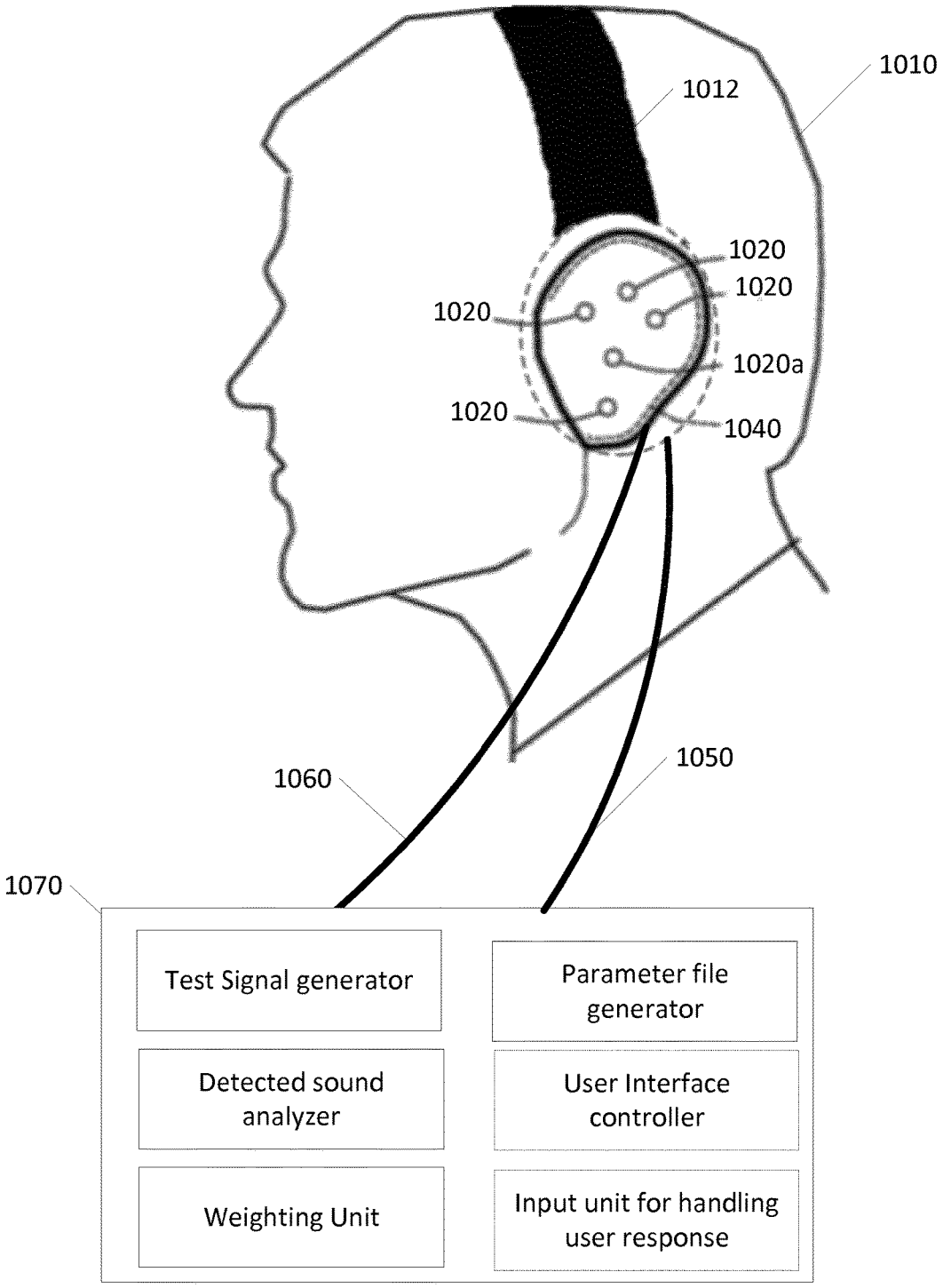
FIG. 10 shows a system and apparatus embodiments for measuring acoustic parameters of a headphone in relation to a reference location.

FIG. 10 shows a system and apparatus embodiments for measuring acoustic parameters of a headphone in relation to a reference location.

Figure 11:
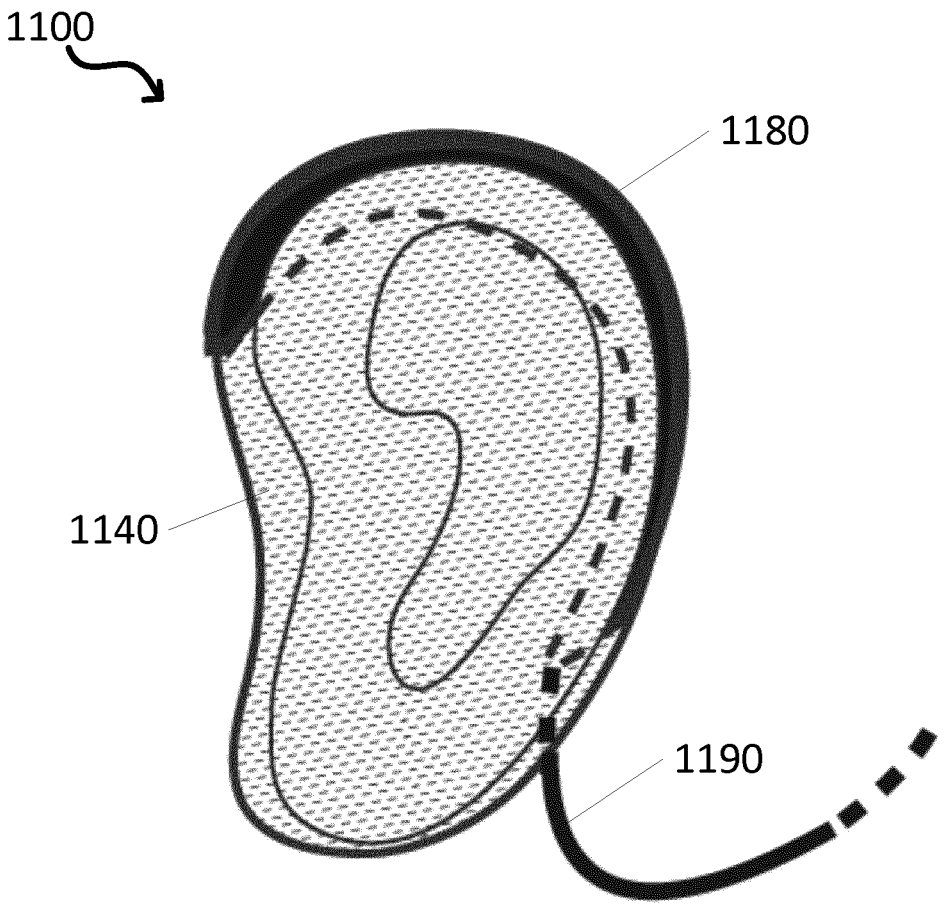
FIG. 11 shows an apparatus embodiment for measuring acoustic parameters of a headphone in relation to a reference location.

Embodiments include head 1010 being an actual or a simulated human head. Headphone-microphone interface 1040 may be a stretchable, substantially acoustically transparent material (e.g., soft speaker grill material) forming an ear sock that fits over an actual or simulated ear, as shown in FIG. 11.

The interface 1040 further includes a plurality of microphones 1020. In ear sock embodiments, the microphones 1020 may be embedded or otherwise attached to the stretchable, acoustically transparent material of interface 1040.

Interface 1040 may also reside within a reference headphone, wherein interface 1040 suspends microphones 1020 in front of the electroacoustic transducer. Further still, substrate 1040 may reside within or on a test fixture such as a human head model or ear simulator. For example, interface 1040 may be an artificial ear with microphones 1020 attached or embedded within the ear. Microphone 1020*a* may be a microphone residing in an artificial ear canal. In such embodiments, 1020*a*, as seen in FIG. 10, shows the corresponding location of the ear canal microphone.

Microphones 1020 may be assigned a predetermined weight, wherein response values obtained from particular microphones are weighted accordingly. For example, microphone 1020*a* may be given a predetermined weight of 1 and microphones 1020, which may be located in locations that do not correspond to the ear canal, may be given a predetermined weight of less than 1.

Communication interfaces 1050 and 1060 may be wired or wireless. Communication interface 1050 communicatively couples headphones 1012 with signal processor 1070 for signal processor 1070 to transmit, for example, a test signal to be played back on headphones 1012. Communication interface 1060 communicatively couples interface 1040 and/or headphones 1012 with signal processor 1070 to capture, for example, the measured acoustic parameters obtained from microphones 1020. One skilled in the art understands that communication interfaces 1050 and 1060 may reside in a single cord and/or may include traditional analog jacks or a USB interface.

Signal processor 1070 may be implemented in software or hardware or a combination thereof. Signal processor 1070 may be configured to perform the signal processing techniques described in this description, including generating filter parameters.

The parameter file may be loaded into a playback application, an equalizer along a signal path and/or a VST or other audio plug-ins for processing audio signals.

Signal processor 1070 includes a test signal generator for generating test signals, a detected sound analyzer for calculating various acoustic parameters based on the measured acoustic signals, and a weighting unit for assigning the calculated acoustic parameters weights that determine a contribution to a filtering curve or filter parameters.

Signal processor 1070 may also include user interface controller and input unit for handling user responses. Said controller in unit may be used to display and operate user interface 160 of FIG. 1. For example, user interface 160 may be able to control the weighting value among different measurement locations (e.g., a value between 0 and 1), the type of test signals, their commencement, and ending the test signal generation. Further, the user interface 160 may display results of the detected sound analyzer module.

FIG. 11 shows an apparatus embodiment for measuring acoustic parameters of a headphone in relation to a reference location. Ear sock 1100 includes microphones (not shown) embedded or otherwise attached to the stretchable, acoustically transparent material of interface 1140. Said ears sock 1100 may have an elastic lining such that interface 1040 may fit snugly around an ear.

Ear sock 1100 includes rigid portion 1180, which interfaces with or cups, for example, the backsides of the helix and concha (i.e., the opposite side of the ear facing the sound emitting side of the headphone earpiece). Thus, the interface 1140 may stretch from rigid portion 1180 resting on the backside of the helix and/or concha, across the front of the ear, and behind the lobe or lobule.

Communication interfaces 1190 may be wired or wireless. Communication interface 1190 may perform any and all of the functionalities in the same matter (e.g., wired or wireless) described for communication interface 1060 and will not be discussed further.

One advantage of the ear sock embodiment is obtaining measurement locations between multiple headsets and a human user. Thus, an equalization filter may be determined for different make and models of the headphones which are based on measurements taken between the user's ear or ears and the sound emitting side of a headphone.

Another advantage of the ear sock embodiment includes an implementation wherein a user may use the headphone and microphone jacks of a home computer that is configured to perform the measurement and equalization techniques described in the present description. Said jacks interface, for example, signal processor 1070 shown in FIG. 10, with microphones of ear sock 1100 and headphones.

Determining EQ Filter Parameters

Figure 12:
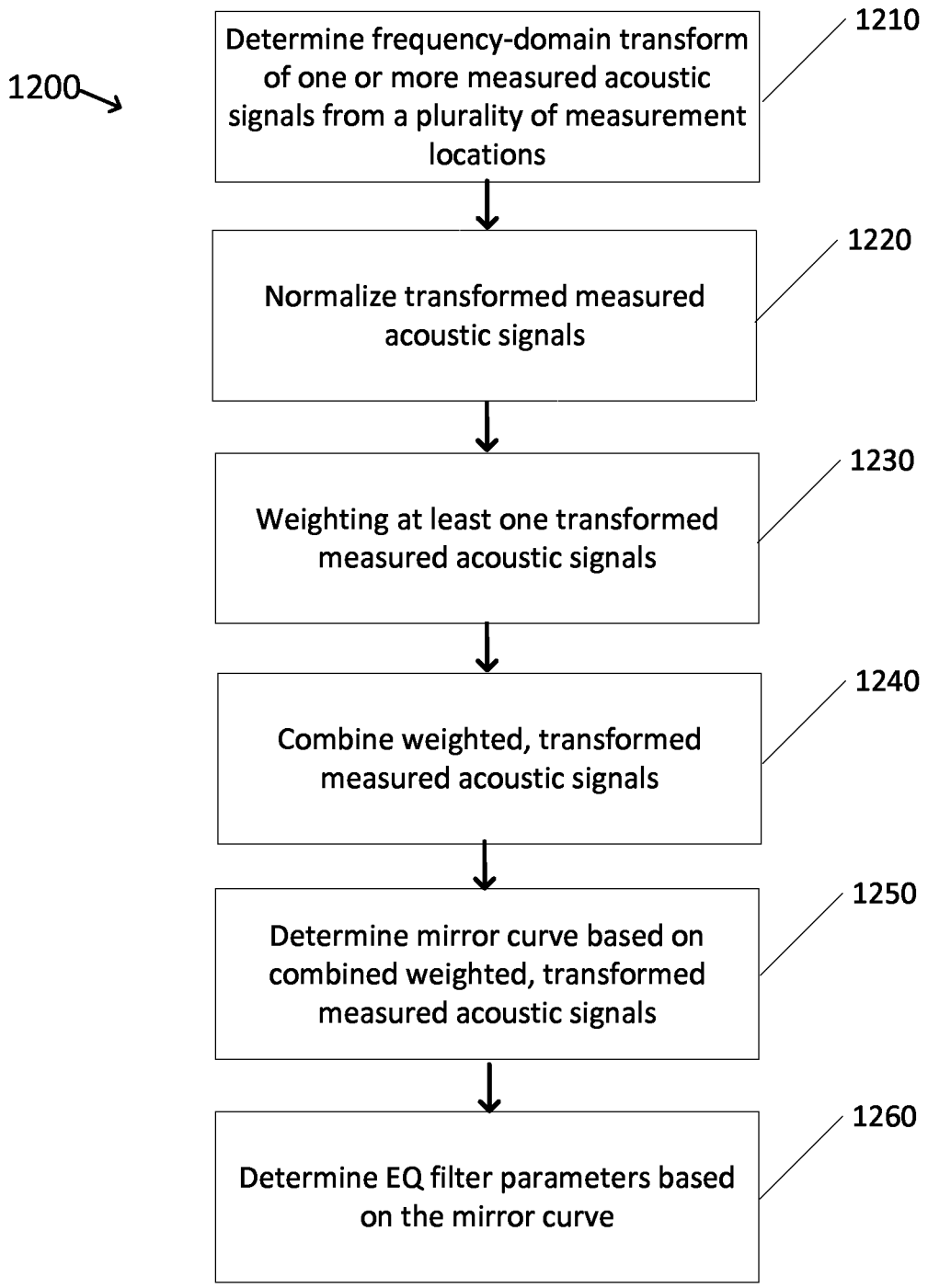
FIG. 12 shows a flow chart of an example embodiment method of determining equalization filter parameters for a headphone.
Figure 13:
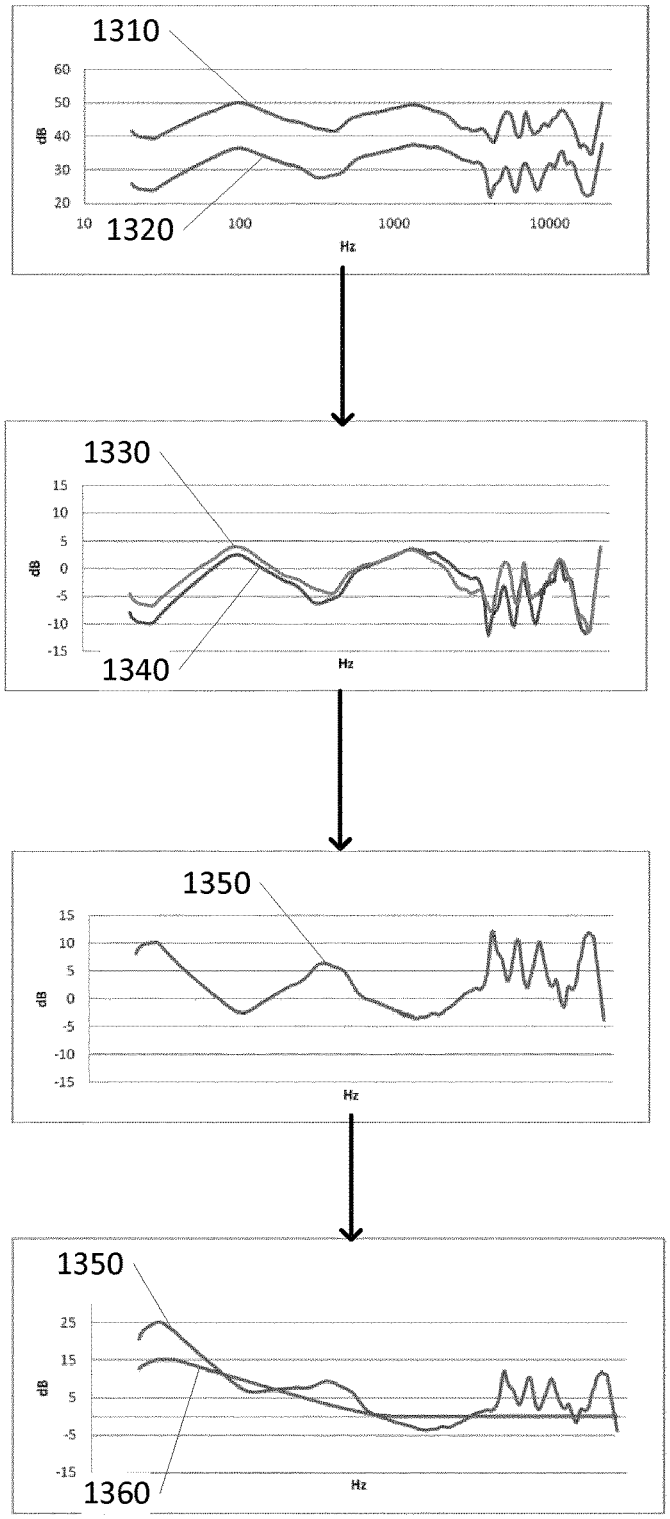
FIG. 13 shows response curves associated with the example embodiment method of FIG. 12.

FIG. 12 shows a flow chart of an example embodiment method of determining equalization filter parameters for a headphone. FIG. 13 shows response curves associated with the example embodiment method of FIG. 12.

Method 1200 determines an equalization filter parameters based on a weighted average of amplitude response values measured from a plurality of measurement locations, the measurement locations corresponding to locations along a reference plane substantially parallel to the sound emitting side of a headphone earpiece.

At step 1210, the one or more measured acoustic signals may be transformed from the time domain to the frequency domain by applying, for example, a Fast Fourier Transform.

Curves 1310 and 1320 respectively represent the frequency response at two different measurement locations corresponding to different locations along a plane substantially parallel to the headphone transducer.

Step 1220 includes normalizing the transformed measured acoustic signals, as shown by curves 1330 and 1340. Normalization may be used, for example, to accurately compare left and right channels of a headphone, different headphones, and measurements made with different equipment such that the measured values are acoustically comparable.

Signal level normalization for each measurement, using a normalization coefficient, may be achieved as follows.

First, calculate frequency grid points $f_0 \ldots f_k$; where $f_0$ and $f_k$ correspond to minimal and maximal frequency respectively for determining a normalization coefficient.

Next, a normalization coefficient may be determined by:

$$C = \frac{A(n) + A(n+1) + \ldots + A(m)}{m - n},$$

where n corresponds to $f_n$=300 Hz, m corresponds to $f_m$=3000 Hz and A(i) is an amplitude response value at grid point i. An amplitude response value may be, for example, a measured SPL for a given frequency. Other frequency ranges may be used.

For each frequency range point i=0 . . . k, one may calculate $F(i)=A_I(i)-C$; where $A_I$ is the initial amplitude response before normalization, e.g., curves 1210 and 1220.

Steps 1230 and 1240 weight at least one transformed measured acoustic signal (i.e., amplitude response values) and combine the weighted signals. This may be achieved by determining an averaged amplitude response calculation within each area $F_q$. The total amplitude response calculation from all measurements, using weighting coefficients may include:

Number of areas: p.

Areas: $Q_1, Q_2 \ldots Q_p$.

Corresponding weight coefficients: $W_1, W_2 \ldots W_p$.

$F_1, F_2 \ldots F_p$: corresponding amplitude response curves for areas $Q_1, Q_2 \ldots Q_p$.

For each amplitude response value $$F_t = \frac{F_1 W_1 + F_2 W_2 + \ldots + F_p W_p}{W_1 + W_2 + \ldots + W_p}.$$

The weighting may be related to a distance between the measurement location and a location corresponding to an anatomical structure of an ear.

For example, areas Qp may be weighting areas 220, 230, 240, and 250 of FIG. 2*a*. Thus step 1240 may determine a composite response curve.

Step 1250 determines a mirror curve based on the combined weighted and transformed measured acoustic signals (e.g., a composite response curve), as represented by curve 1350. Each point comprising curve 1350 may be determined by: $F_{xm}=-F_t$.

Curve 1350 may represent a desired equalization filter response or equalization filter parameters. Curve 1350 may be used as the basis to generate, for example, filter parameters or a smoothed response curve, which corrects for the measured nonlinearities of a headphone, as represented by curve 1360.

Each point of curve 1360 may be determined by: $F_{res}=F_{xm}+F_{tr}$, where $F_{tr}$ is a target curve value in a selected amplitude response grid point. Curve 1360 may then be a simplified or smoothed version of curve 1350. Curve 1360 may represent filter parameters for a parametric equalizer.

EQ Playback

Figure 14:
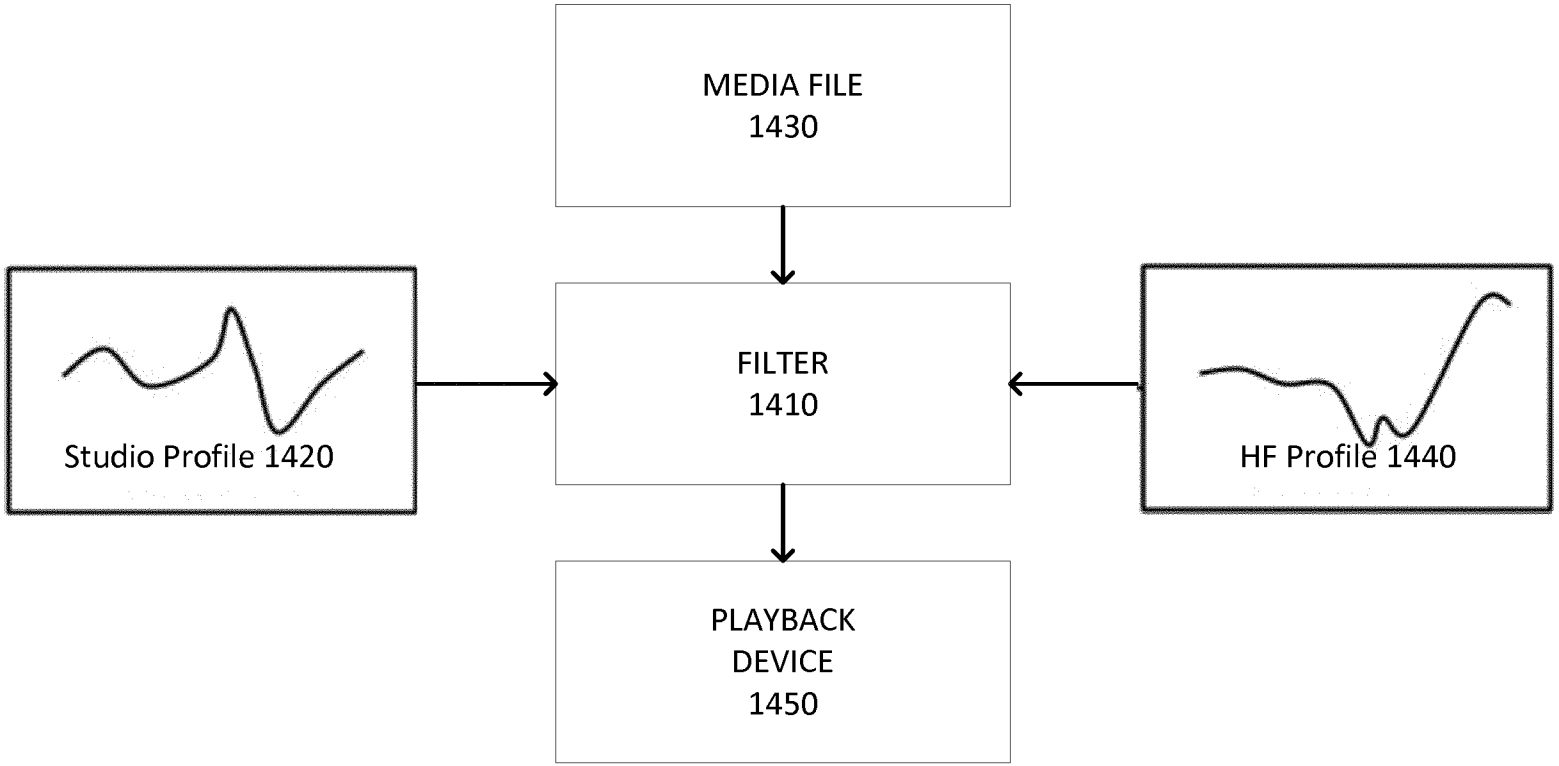
FIG. 14 schematically shows an example of an embodiment technique for determining an equalization filter for a headphone.

FIG. 14 shows a flow chart illustrating a technique for determining an equalization filter for a headphone, in particular filter 1410. Filter 1410 may be determined by receiving information such as a studio profile 1420.

Studio profile 1420 may alternatively be a song or album profile comprise data representing a mastering curve specific to the song or album. The mastering curve may achieve the goal of modifying media file 1430 in such a way that the listener perceives the sound balance as it was perceived in the mixing studio.

The headphone profile 1440 (HF profile) may correct for local resonances and other nonlinearities of a headphone such that the studio profile 1420 may be treated as a target curve, thereby achieving a spectral balance of a headphone that matches the mixing studio environment.

This may be achieved by producing a composite set of filter parameters based on the studio and HF profiles 1420 and 1440. For example, a composite set of filter parameters may reflect a composite curve that is a difference (e.g., subtraction of respective values) between the EQ curves reflected in the studio and HF profiles 1420 and 1440.

Studio profile 1420 may include a mastering curve, wherein, for example, artist/producer choosing mastering curve on a calibrated device such as calibrated headphones. That is, the mastering curve may be determined based on playback over calibrated headphones.

Additionally or alternatively, studio profile 1420 may include parameters reflecting the acoustic response of the studio mixing room (e.g., room gain), the studio mixing monitors (e.g., radiated acoustic power), or both.

Thus, the studio profile 1420 may contain one or more types of characterization parameters, such as correction parameters.

The correction parameters may be calculated to provide values needed to control an equalization filter (e.g., digital filter coefficients). The correction parameters may have an inverse relationship with the measured acoustic response. For example, one set of characterization parameters may describe a studio monitor's acoustic amplitude response, wherein the correction parameters configure a correction filter to compensate for nonlinearities exhibited by the monitor based on the monitor's acoustic amplitude response.

In some embodiments a composite set of filter parameters may reflect a composite curve based on a studio EQ profile characterizing the acoustic response of the specific room in which a mastering curve was generated, a song/album EQ profile including said mastering curve, and a headphone EQ profile characterizing the acoustic response of the specific headphone of the listener.

If the mastering curve was generated with a reference set of headphones the above studio EQ profile may be instead a second headphone profile characterizing the acoustic response of the specific headphone of the reference headphones.

Filter 1410 may be used to process an incoming media file 1430, which has an audio component such as an mp3 file. The processed audio component information may be then outputted or played by a playback device 1450.

Filter 1410 may include two filters respectively configured by one of the HF and studio profiles 1430 and 1440. The media file 1430 may then be processed serially (e.g., a first filter's output feeding another filter's input).

Filter 1410 may be a single filter reflecting a composite response curve based on studio and HF profiles 1420 and 1440.

Filter 1410 may further reflect other frequency response curves such as a genre EQ curve (e.g., jazz, classical, hip-hop, talk) and other EQ curves (e.g., bass booster/reducer, vocal booster/reducer).

Figure 15:
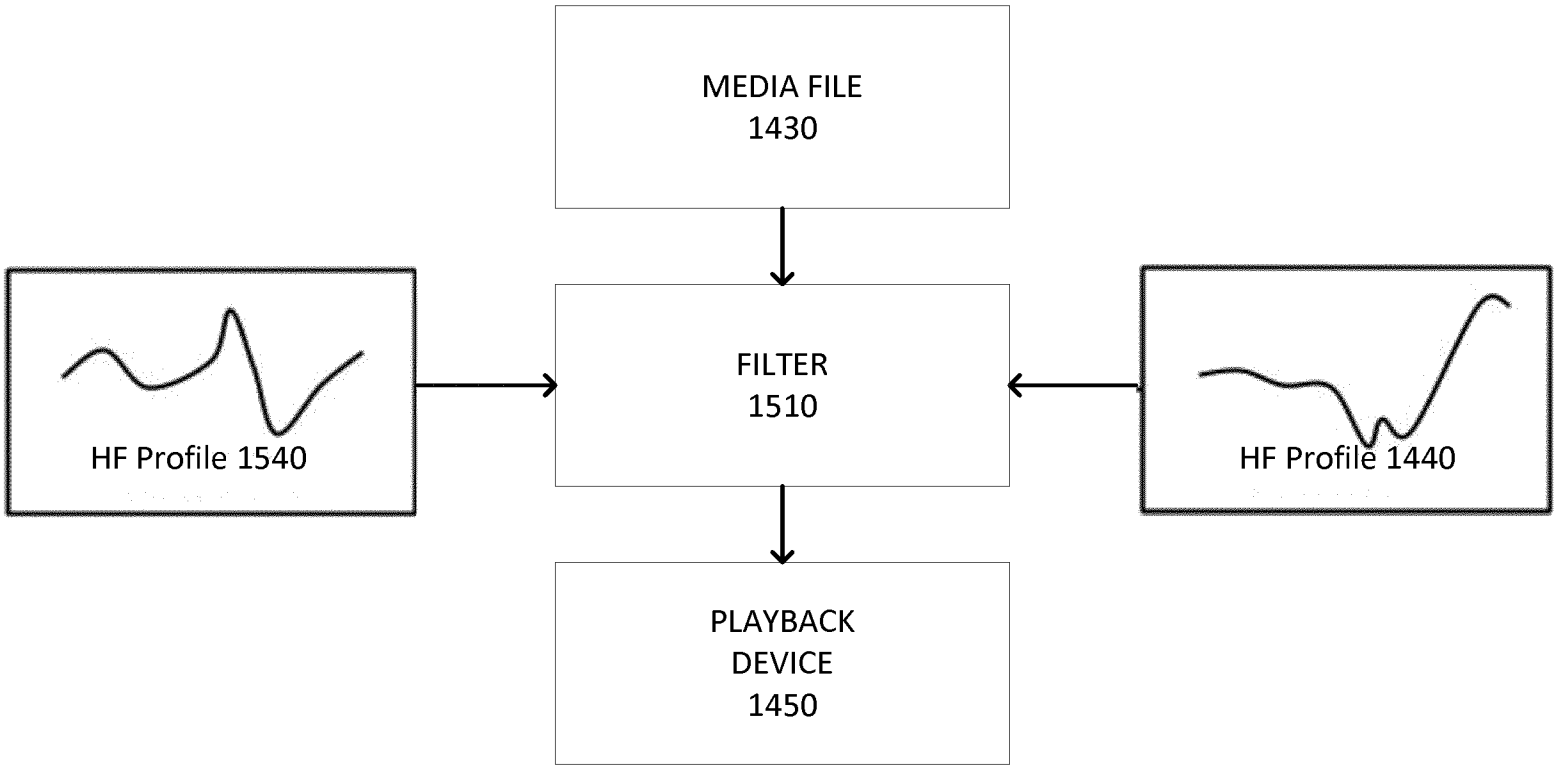
FIG. 15 schematically shows an example of an embodiment technique for determining an equalization filter for a headphone.

FIG. 15 schematically shows another example of an embodiment technique for determining an equalization filter for a headphone, in particular filter 1510. The features shared with the embodiment of FIG. 14 may not be further discussed in describing the embodiment of FIG. 15.

Filter 1510 may be determined based on HF profiles 1440 and 1540. HF profile 1440 may correct for local resonances and other nonlinearities of a user's headphone (i.e., the playback headphone) such that the HF profile 1540 may be treated as a target curve to simulate the spectral balance of a modeled headphone (i.e., a non-playback headphone). This may be achieved by producing a composite set of filter parameters based on the HF profiles 1440 and 1540. For example, a composite set of filter parameters may reflect a composite curve that is a composite curve that is a difference (e.g., subtraction of respective values) between the EQ curves reflected in the HF profiles 1440 and 1540.

The embodiment shown in FIG. 15 allows for simulating a spectral balance of a particular headphone with a different model headphone. To explain further, HF profile 1540 may be generated based on the above described techniques for measuring acoustic parameters of a headphone in relation to a reference location of a reference plane. That is, HF profile 1540 may reflect a composite response curve based on a weighted average of the amplitude response values.

Accurate modeling data of one headphone, such as the above-described composite response curve, can be used as a target curve. Thus, filter 1510 may reflect a further composite response curve based on HF profiles 1440 and 1540.

Filter 1510 may further reflect other frequency response curves such as a genre EQ curve (e.g., jazz, classical, hip-hop, talk) and other EQ curves (e.g., bass booster/reducer, vocal booster/reducer).

Unless stated otherwise, embodiments including studio profile 1420 may alternatively include HF profile 1540 for determining a filter (e.g., filter 1410). Further, HF profile 1540 may instead be a profile characterizing the acoustic response of other electro-acoustic devices such as loudspeakers and guitar amplifiers. Unless stated otherwise, embodiments including studio profile 1420 may alternatively include profiles characterizing the acoustic response of electro-acoustic devices.

Figure 16:
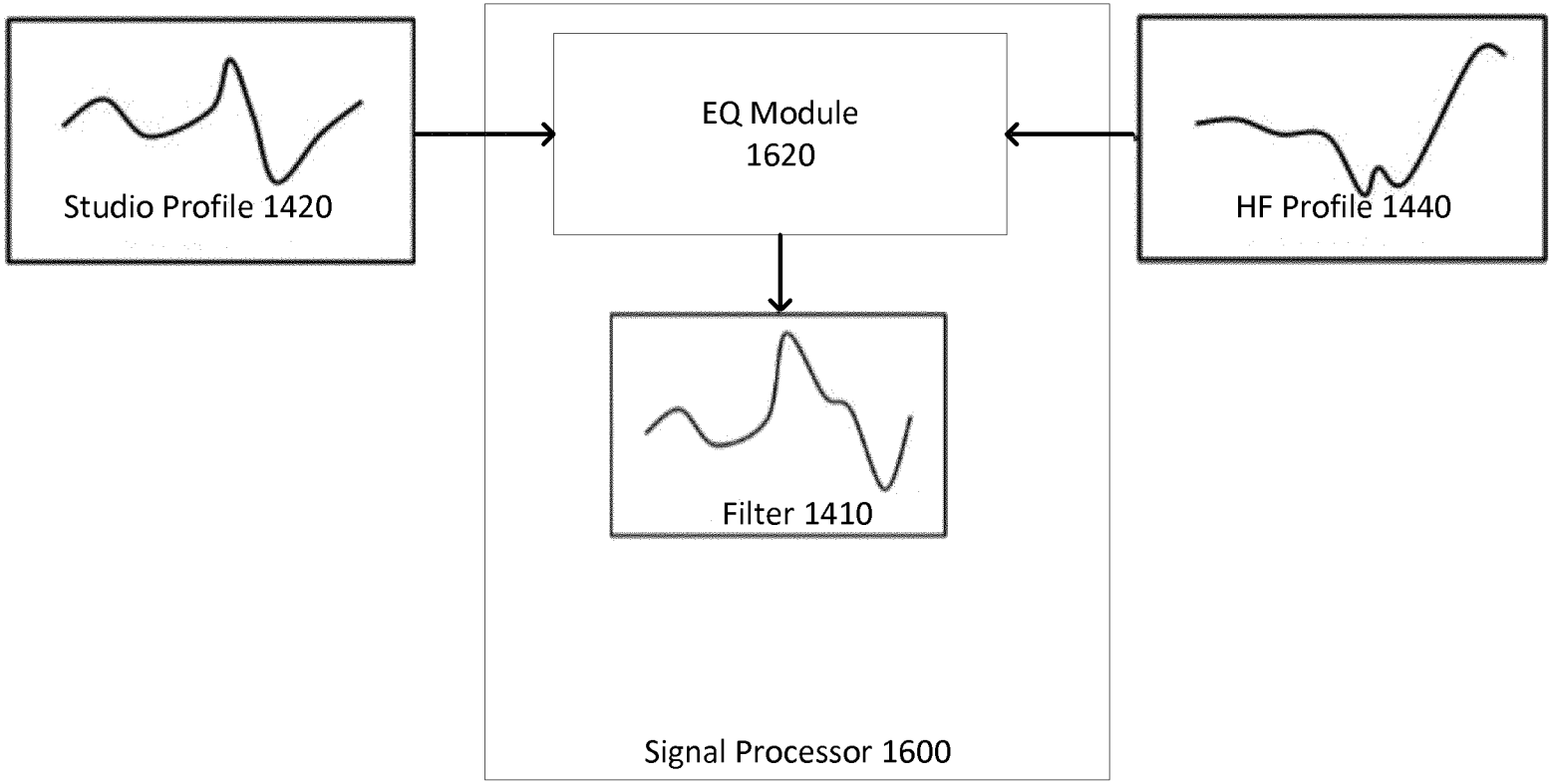
FIG. 16 schematically shows an example of an embodiment of signal processor 1600.

FIG. 16 schematically shows an example of an embodiment of signal processor 1600. Signal processor 1600 obtains studio profile 1420 and headphone profile 1440.

EQ module 1620 configures EQ filter 1410, which may include generating coefficients to control the amplitude response of filter 1410 based on received data such as filter parameters.

For example, EQ module 1620 may receive first and second data based on the data contained in HF and studio profiles 1430 and 1440 or obtained by other means. The first data reflects or corrects (i.e., characterizes) the acoustic response of the headphone and the second data reflects or corrects the acoustic response of a studio mixing room or reflects a mastering curve.

First and second data may include such variables as center frequency, bandwidth, and gain of filter 1410 or digital filter coefficients that determine such variables.

EQ module 1620 may be configured to configure filter 1410 based on the first and second data.

Signal processor 1600 may receive an audio signal, wherein signal processor 1600 may apply filter 1410 (i.e., process the signal via filter 1410). EQ module 1620 may be configured to extract the second data from a media file (e.g., from metadata of the audio signal).

Signal processor 1600 may also output filter 1410 or filter parameters for filter 1410 to another module communicatively coupled to signal processor 1600, wherein said module processes an audio signal using the supplied filter 1410 or filter parameters for filter 1410.

Figure 17:
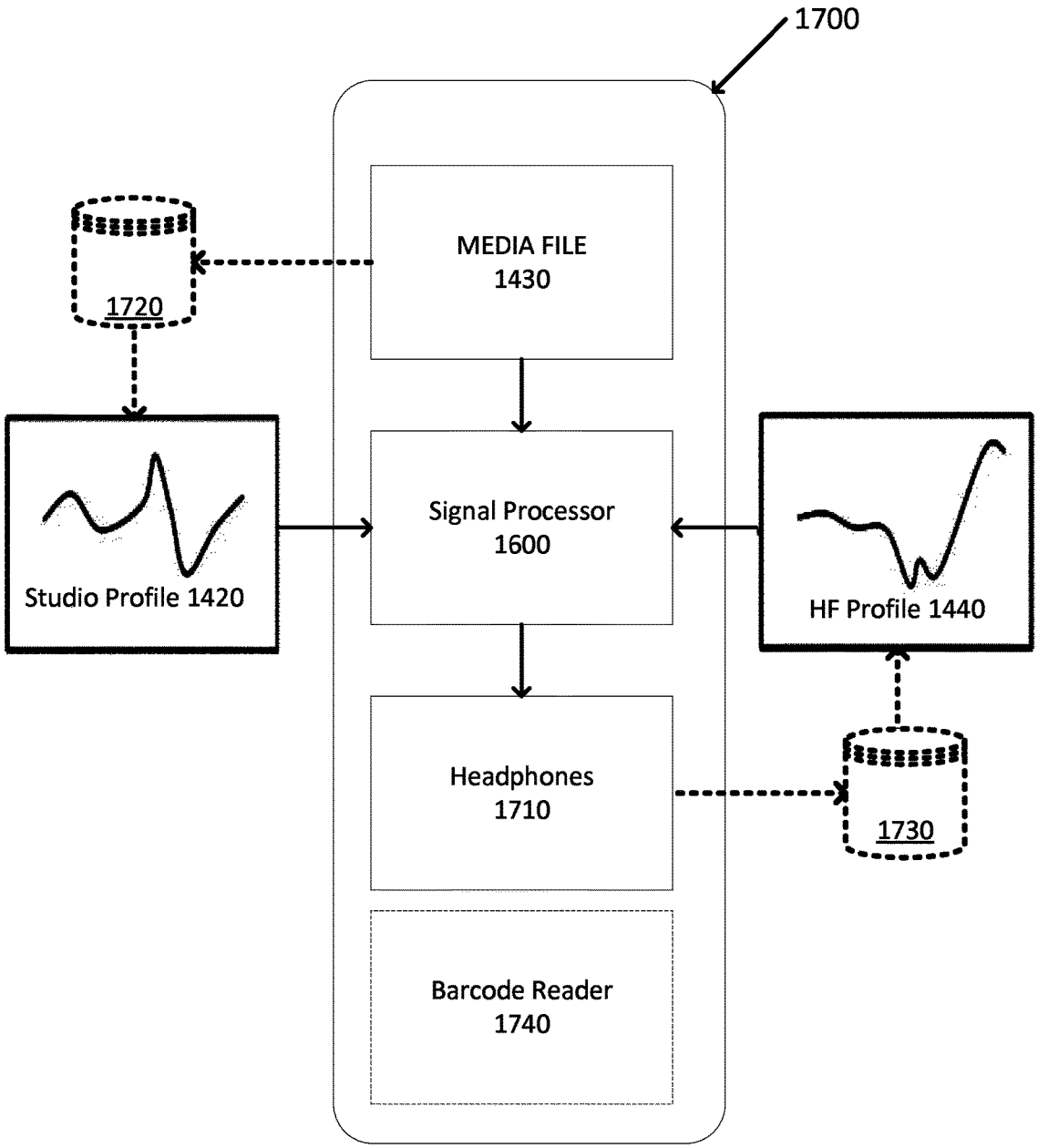
FIG. 17 schematically shows an example of an embodiment of audio playback system.

FIG. 17 schematically shows an example of an embodiment of audio playback system 1700. Playback system 1700 may be partly or fully implemented on a smartphone, PC, or MP3 player with headphones 1710.

Studio profile 1420 and headphone profile 1440 may be obtained from databases 1720 and 1730. Databases 1720 and 1730 may be databases local to audio playback system 1700 or accessed, for example, via the Internet.

Headphone profile 1440 may be distributed several ways in addition or as an alternative to a database. Headphone 1710 may transmit an electronic address such as a URL which contains or accesses headphone profile 1440. For example, headphone 1710 may wirelessly or through wired-means transmit said URL or the headphone profile 1440 itself for processing by signal processor 1600.

Said URL or headphone profile 1440 may also be stored by a barcode such as a QR code. In this example, a user may scan the QR code with a smart phone to directly access headphone profile 1440 or the headphone profile 1440 stored in database 1730 as linked by the code. The QR code or other 2D/1D barcodes may reside on headphones 410 (e.g., a sticker affixed thereon) or associated packaging thereof.

As one example, headphone profile 1440 may comprise a first data that characterizes the acoustic response of headphones 1710. A 1D or 2D barcode may encode EQ filter parameter data that configures a digital filter.

As another example, filter parameters may be obtained by direct measurement of the headphones 1710, as described earlier in the description.

Barcode reader 1740 may be a camera or other electronic device configured to read printed barcodes.

Studio profile 1420 may be received or obtained from database 1720, which may link songs or tracks with a studio profile. For example, media file 1430 may include data identifying studio profile 1420 within database 1720. Database 1720 may reside within a music player application (e.g., local to audio playback system 1700), or may be accessible via the Internet.

Studio profile 1420 may be distributed several ways in addition or as an alternative to database 1720. The studio profile 1420 may be metadata or otherwise encoded in media file 1430 (e.g., watermarked).

Alternatively or additionally, database 1720 may include headphone profiles and/or profiles characterizing the acoustic response of other electro-acoustic devices. In such embodiments, a user may be able to select from several makes and models of headphones, loudspeakers, and/or guitar amplifiers whose spectral balance may be simulated with headphones 1710. That is, signal processor 1600 receives, for example, a headphone profile for a headphone that differs in make and/or model of HF profile 1440, which corresponds to headphones 1710.

For example, media file 1430 may be mastered using a particular reference headphone. Media file 1430 may include or identify a headphone profile corresponding to the reference headphone, which is a different make and/or model to the headphone that corresponds HF profile 1440 (e.g., headphones 1710). The reference headphone profile may be treated as a target curve such that signal processor 1600 creates a filter to simulate the spectral balance (e.g., as shown by a measured frequency response curve) of the reference headphones with headphones 1710.

Figure 18:
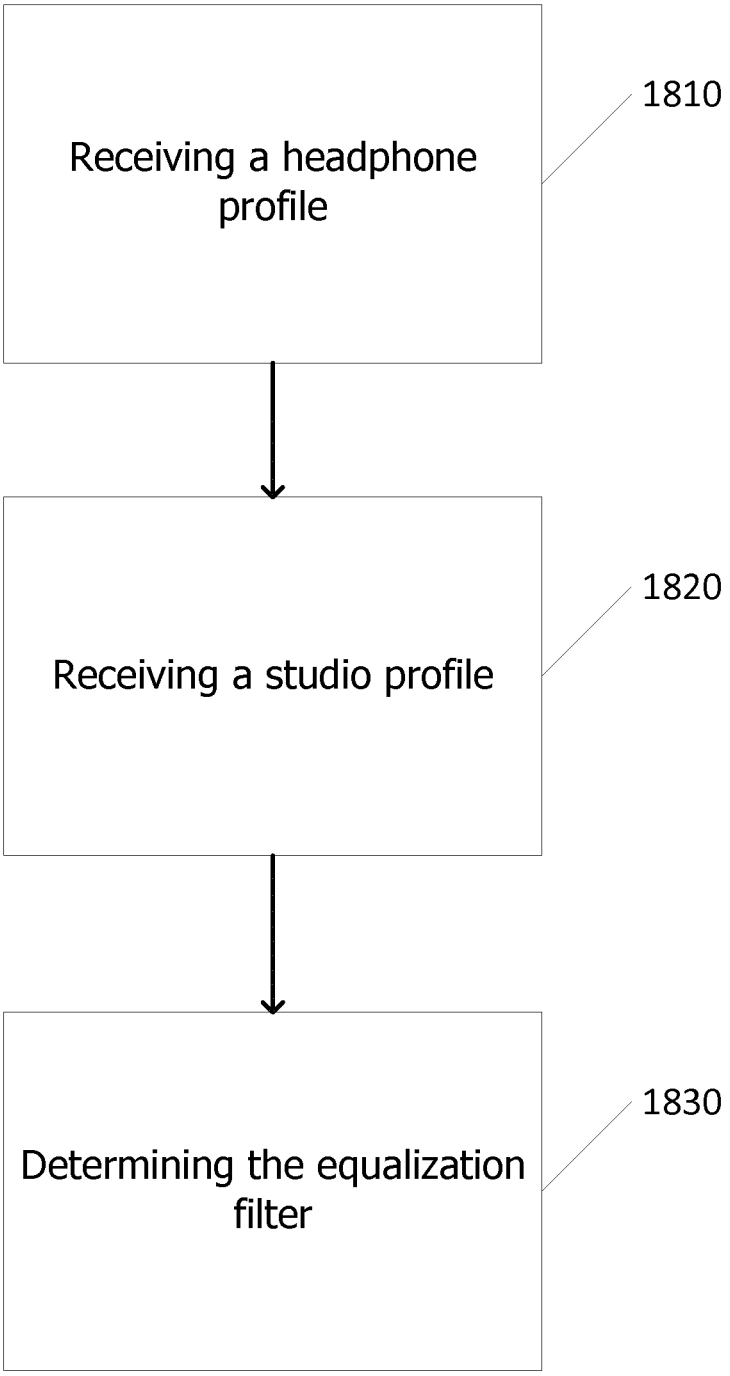
FIG. 18 shows a flow chart of an example embodiment method of determining an equalization filter for a headphone.

FIG. 18 shows a flow chart of an example embodiment method of determining an equalization filter for a headphone.

Step 1810 includes receiving a headphone profile comprising a first data that characterizes the acoustic response of a headphone. The first data may reflect a composite response curve based on a weighted average of amplitude response values measured from a plurality of measurement locations, as explained above.

Step 1820 includes receiving a studio profile comprising a second data that characterizes the acoustic response of a studio mixing room. An alternative to this step may be receiving second data that reflects a mastering curve or characterizes the acoustic response of other electro-acoustic devices.

The studio profile may be metadata or otherwise encoded in a received media file (e.g., watermarked). The studio profile may be extracted from a received media file.

Step 1830 includes determining the equalization filter based on at least the headphone profile and the studio profile, as described above.

Figure 19:
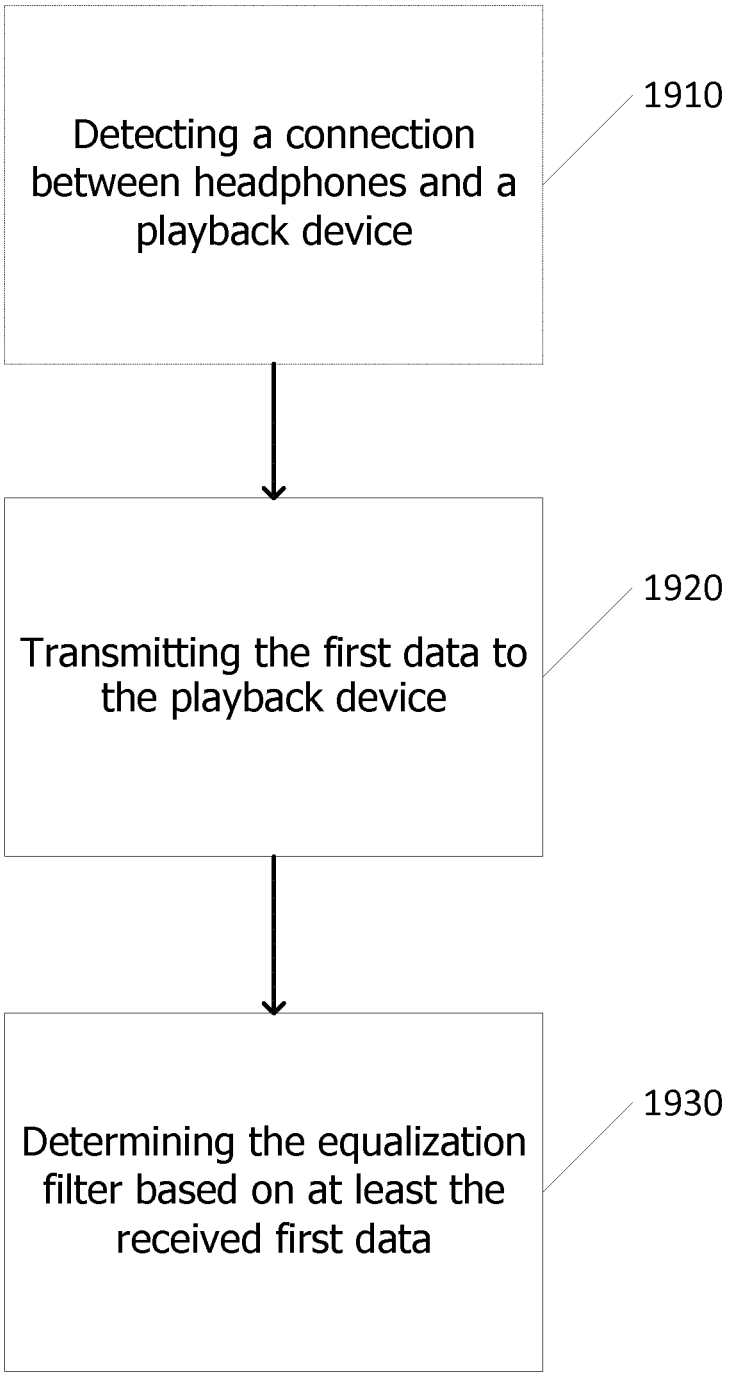
FIG. 19 shows another flow chart of an example embodiment method of determining an equalization filter for a headphone.

FIG. 19 shows a flow chart of an example embodiment method of determining an equalization filter for a headphone.

Step 1910 includes detecting a connection between headphones and a playback device, such as personal computer, smart phone, MP3 player, or internet radio. Detection may occur on the device side, the headphone side, or both sides. Detection may include detecting an analog headphone jack or USB interface physically connecting with the corresponding female connection.

Detection may include wirelessly detecting, such as pairing Bluetooth devices together. Wireless embodiments also include active, semi-active, and passive RFID embodiments.

Alternative embodiments do not include the detection step.

Step 1920 includes transmitting the first data to the playback device, the first data characterizing the acoustic response of a headphone. The first data may reflect a composite response curve based on a weighted average of amplitude response values measured from a plurality of measurement locations, as explained above.

Transmitting may be preformed by headphones via wire or wirelessly. Wireless embodiments include active, semi-active, and passive RFID embodiments. For example, parameters correcting a headphone's acoustic response may be encoded on an RFID chip located on or in a headphone or packaging thereof.

However, other components, such as a database, may contain the parameters to be transmitted to the playback device. In embodiments including step 1910, step 1920 may be performed conditionally upon detecting a connection in step 1910.

Step 1930 includes determining the equalization filter based on at least the headphone profile and the studio profile, as described above.

Figure 20:
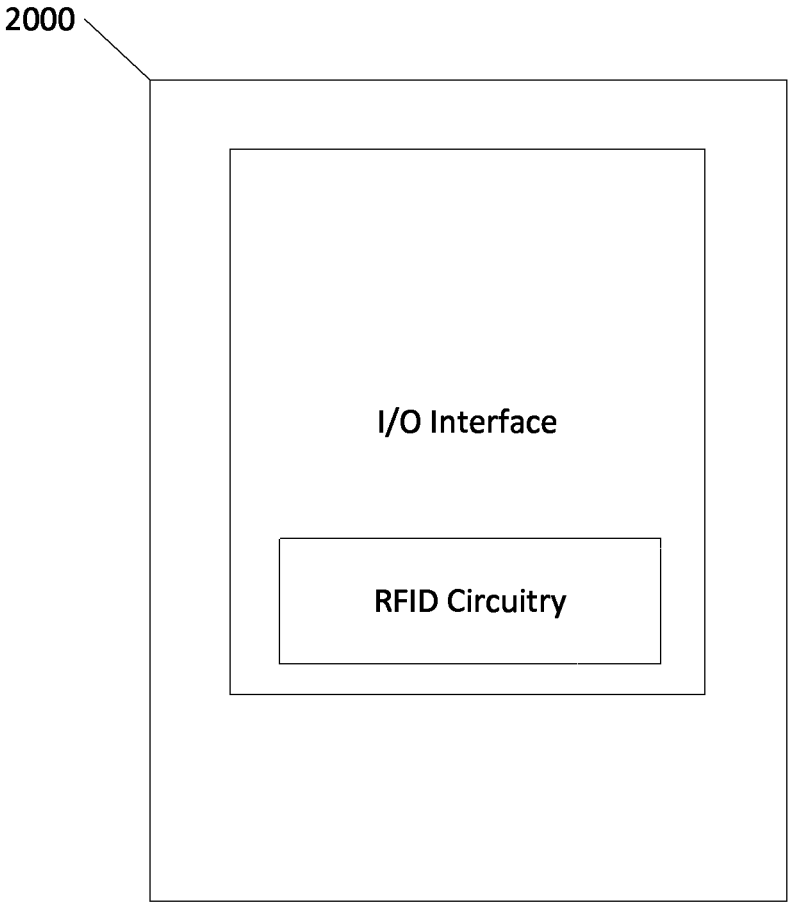
FIG. 20 schematically shows an example of an embodiment of headphone 2000.

FIG. 20 schematically shows an example of an embodiment of headphone 2000. The I/O interface module may include circuitry for wire or wirelessly transmission of acoustic parameters. Wireless embodiments include active, semi-active, and passive RFID embodiments as RFID circuitry. For example, parameters (or an electronic address thereof) correcting the acoustic response of headphone 2000 may be encoded on an RFID chip located on or in headphone 2000 or packaging thereof.

In the foregoing specification, the invention has been described with reference to specific examples of embodiments of the invention. It will, however, be evident that various modifications and changes may be made therein without departing from the broader spirit and scope of the invention as set forth in the appended claims. Furthermore, those skilled in the art will recognize that boundaries between the above described modules are merely illustrative. The multiple modules may be combined into a single module, a single module may be distributed in additional modules and modules may be executed at least partially overlapping in time. Moreover, alternative embodiments may include multiple instances of a particular module, and the order of modules may be altered in various other embodiments.

However, other modifications, variations and alternatives are also possible. The specifications and drawings are, accordingly, to be regarded in an illustrative rather than in a restrictive sense.

The invention may also be implemented in a computer program for running on a computer circuit, at least including code portions for performing steps of a method according to the invention when run on a programmable apparatus, such as a computer circuit or enabling a programmable apparatus to perform functions of a device or circuit according to the invention.

A computer program is a list of instructions such as a particular application program and/or an operating circuit. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a computer circuit.

The computer program may be stored internally on computer readable storage medium or transmitted to the computer circuit via a computer readable transmission medium. All or some of the computer program may be provided on transitory or non-transitory computer readable media permanently, removably or remotely coupled to an information processing circuit. The computer readable media may include, for example and without limitation, any number of the following: magnetic storage media including disk and tape storage media; optical storage media such as compact disk media (e.g., CD-ROM, CD-R, etc.) and digital video disk storage media; nonvolatile memory storage media including semiconductor-based memory units such as FLASH memory, EEPROM, EPROM, ROM; ferromagnetic digital memories; MRAM; volatile storage media including registers, buffers or caches, main memory, RAM, etc.; and data transmission media including computer networks, point-to-point telecommunication equipment, and carrier wave transmission media, just to name a few.

A computer process typically includes an executing (running) program or portion of a program, current program values and state information, and the resources used by the operating circuit to manage the execution of the process. An operating circuit (OS) is the software that manages the sharing of the resources of a computer and provides programmers with an interface used to access those resources. An operating circuit processes circuit data and user input, and responds by allocating and managing tasks and internal circuit resources as a service to users and programs of the circuit.

The computer circuit may for instance include at least one processing unit, associated memory and a number of input/output (I/O) devices. When executing the computer program, the computer circuit processes information according to the computer program and produces resultant output information via I/O devices.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time-multiplexed manner. Likewise, single connections carrying multiple signals may be separated out into various different connections carrying subsets of these signals. Therefore, many options exist for transferring signals.

In the claims, the word 'comprising' does not exclude the presence of other elements or steps then those listed in a claim. Furthermore, the terms "a" or "an," as used herein, are defined as one or more than one. The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements.

The invention claimed is:

1. A method of determining an equalization filter for headphones, the method comprising:

receiving first data that characterizes the acoustic response of the headphones, receiving second data that reflects a mastering curve;

determining the equalization filter based on the first data and the second data; and extracting the second data from a media file.

2. The method of claim 1, wherein the second data includes at least one of a studio EQ profile, a song EQ profile, or an album EQ profile, the studio profile comprises data characterizing the acoustic room response of a particular studio room, the song EQ profile comprises data comprises data reflecting a first mastering curve for a particular media file, and the album EQ profile comprises data comprises data reflecting a second mastering curve for a particular group of media files.

3. The method of claim 2, wherein the first mastering curve was generated specifically for the particular media file and the second mastering curve was generated specifically for the particular group of media files.

4. An audio playback system for headphones, the system comprising:

an equalization module configured to:

receive first data that characterizes the acoustic response of the headphones, receive second data that reflects a mastering curve;

configure an equalization filter based on the first data and the second data; and extract the second data from a media file.

5. The system of claim 4, wherein the headphone comprises circuitry operable to transmit the first data or an electronic address of the first data.

6. The system of claim 4, wherein the second data includes at least one of a studio EQ profile, a song EQ profile, or an album EQ profile, the studio profile comprises data characterizing the acoustic room response of a particular studio room, the song EQ profile comprises data comprises data reflecting a first mastering curve for a particular media file, and the album EQ profile comprises data comprises data reflecting a second mastering curve for a particular group of media files.

7. The system of claim 6, wherein the first mastering curve was generated specifically for the particular media file and the second mastering curve was generated specifically for the particular group of media files.

8. A method of determining equalization filter parameters for a headphone, the method comprising:

determining a composite response curve based on an average of amplitude response values measured from a plurality of measurement locations, the plurality of measurement locations, in cumulative, substantially spanning at least a transducer of the headphone; and determining the equalization filter parameters based on the determined composite response curve.

9. The method of claim 8, wherein the determining step further comprises weighting amplitude response values measured from at least one of the plurality of measurement locations in relation to a distance between a reference location and the location of the at least one measurement location.

10. The method of claim 9, further comprising:

determining an area of a sound emitting side of an earpiece of the headphone physically or acoustically coupled to a headphone-microphone interface, and determining the reference location based on the determined area.

11. The method of claim 9, the method further comprising:

determining if one or more of the amplitude response values equal or exceed an amplitude distortion value threshold; and omitting the determined one or more amplitude response values from the weighted average of amplitude response values.

12. A method of processing an audio signal, the method comprising:

configuring an equalization filter using equalization filter parameters obtained using amplitude response values measured from a plurality of measurement locations, the plurality of measurement locations, in cumulative, substantially spanning a headphone transducer; and processing the audio signal via the configured equalization filter.

13. A method of determining an equalization filter for headphones, the method comprising:

receiving a first data that characterizes the acoustic response of the headphones, determining the equalization filter based on the first data, wherein the first data reflects a composite response curve based on an average of amplitude response values measured from a plurality of measurement locations, the plurality of measurement locations, in cumulative, substantially spanning at least a headphone transducer.

14. The method of claim 13, further comprising:

receiving second data that characterizes the acoustic response of an electro-acoustic device, wherein determining the equalization filter comprises determining the equalization filter based on the first and second data.

15. The method of claim 14, wherein the electro-acoustic device is a second headphone and the second data reflects a second composite response curve based on based on a second average of amplitude response values measured from a second plurality of measurement locations, the plurality of measurement locations, in cumulative, substantially spanning at least a headphone transducer of the second headphone.

16. The method of claim 13, further comprising:

receiving second data that characterizes the acoustic response of a studio mixing room or reflects a mastering curve, wherein determining the equalization filter comprises determining the equalization filter based on the first and second data.

17. The method of claim 13, further comprising extracting the second data from a media file.

18. An apparatus comprising:

an equalization filter with an amplitude response reflecting a composite response curve based on an average of amplitude response values measured from a plurality of measurement locations, the plurality of measurement locations, in cumulative, substantially spanning at least a headphone transducer.

19. An audio playback system comprising:

an equalization module configured to:

receive a first data that characterizes the acoustic response of the headphone, configure an equalization filter based on the first data, wherein the first data reflects a composite response curve based on an average of amplitude response values measured from a plurality of measurement locations, the plurality of measurement locations, in cumulative, substantially spanning at least a headphone transducer.

20. The system of claim 19, wherein the equalization module is further configured to:

receive second data that characterizes the acoustic response of an electro-acoustic device, wherein the equalization module is configured to configure the equalization filter based on the first and second data.

21. The system of claim 20, wherein the electro-acoustic device is a second headphone and the second data reflects a second composite response curve based on a second average of amplitude response values measured from a second plurality of measurement locations, the plurality of measurement locations, in cumulative, substantially spanning at least a headphone transducer of the second headphone.

22. The system of claim 19, wherein the equalization module is further configured to:

receive second data that reflects or corrects the acoustic response of a studio mixing room or reflects a mastering curve, wherein the equalization module is configured to configure the equalization filter based on the first and second data.

23. The system of claim 20, wherein the equalization module is further configured to extract the second data from a media file.

* * * * *